US010927783B2

(12) United States Patent
Dölker

(10) Patent No.: US 10,927,783 B2
(45) Date of Patent: Feb. 23, 2021

(54) METHOD FOR ASCERTAINING A CONTINUOUS INJECTION OF A COMBUSTION CHAMBER, INJECTION SYSTEM, AND INTERNAL COMBUSTION ENGINE COMPRISING SUCH AN INJECTION SYSTEM

(71) Applicant: MTU FRIEDRICHSHAFEN GMBH, Friedrichshafen (DE)

(72) Inventor: Armin Dölker, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 0 days.

(21) Appl. No.: 16/603,747

(22) PCT Filed: Apr. 5, 2018

(86) PCT No.: PCT/EP2018/058804
§ 371 (c)(1),
(2) Date: Oct. 8, 2019

(87) PCT Pub. No.: WO2018/189038
PCT Pub. Date: Oct. 18, 2018

(65) Prior Publication Data

US 2020/0116097 A1 Apr. 16, 2020

(30) Foreign Application Priority Data

Apr. 13, 2017 (DE) ..... 10 2017 206 416.1

(51) Int. Cl.
*F02D 41/22* (2006.01)
*F02M 63/02* (2006.01)
(Continued)

(52) U.S. Cl.
CPC ..... *F02D 41/221* (2013.01); *F02M 63/0225* (2013.01); *F02D 41/3836* (2013.01);
(Continued)

(58) Field of Classification Search
CPC .... F02D 41/22; F02D 41/221; F02D 41/3836; F02D 2041/225; F02D 2200/0602; F02D 2250/14; F02M 63/02; F02M 63/0225
(Continued)

(56) References Cited

U.S. PATENT DOCUMENTS 4,421,088 A 12/1983 Seilly
5,727,516 A 3/1998 Augustin
(Continued)

FOREIGN PATENT DOCUMENTS

DE 3126393 A1 4/1982
DE 102011100187 A1 5/2008
(Continued)

*Primary Examiner* — John Kwon
*Assistant Examiner* — Johnny H Hoang
(74) *Attorney, Agent, or Firm* — Lucas & Mercanti, LLP; Klaus P. Stoffel

(57) ABSTRACT

A method for identifying a continuously injecting combustion chamber of an internal combustion engine which has an injection system with a high-pressure accumulator for a fuel, having the following steps: time-dependent sensing of a high pressure in the injection system; starting a continuous-injection detection process at a starting time while the internal combustion engine is operating; identifying a start time of a pressure drop which occurs chronologically before the starting time and at which the high pressure in the injection system begins to drop if continuous injection has been detected; and identifying at least one combustion chamber to which the continuous injection can be assigned, on the basis of the start time of the pressure drop.

13 Claims, 8 Drawing Sheets

(51) Int. Cl.
*F02D 41/38* (2006.01)
*F02D 41/40* (2006.01)

(52) U.S. Cl.
CPC ..... *F02D 41/402* (2013.01); *F02D 2041/224* (2013.01); *F02D 2200/0602* (2013.01); *F02D 2250/04* (2013.01)

(58) Field of Classification Search
USPC ..... 123/299–305, 478
See application file for complete search history.

(56) References Cited

U.S. PATENT DOCUMENTS 6,250,285 B1 * 6/2001 Takase ..... F02D 41/221 123/456
6,463,910 B2 * 10/2002 Nishiyama ..... F02D 41/401 123/447
7,762,234 B2 * 7/2010 Ulrey ..... F02D 41/3845 123/456
8,812,215 B2 * 8/2014 Sugiyama ..... F02D 41/406 701/104
9,002,666 B2 4/2015 Takashima
9,347,409 B2 5/2016 Dölker
9,588,016 B2 * 3/2017 Ishizuka ..... F02M 47/027
9,903,331 B2 2/2018 Walder et al.
2004/0055576 A1 * 3/2004 McCarthy, Jr. ..... F02P 5/045 123/458
2008/0041331 A1 * 2/2008 Puckett ..... F02D 41/38 123/198 D
2010/0043753 A1 * 2/2010 Gallagher ..... F02D 35/024 123/447
2012/0234295 A1 9/2012 Tsuiki
2018/0010542 A1 1/2018 Dölker

FOREIGN PATENT DOCUMENTS

DE 102012100735 A1 8/2012
DE 112010004995 T5 1/2013
DE 102011087835 B3 6/2013
DE 102013101905 A1 8/2013
DE 02013216255 B3 11/2014
DE 102015207961 A1 11/2016
EP 1205657 A2 5/2002
WO 2015022058 A1 2/2015
WO 2016173589 A1 11/2016

* cited by examiner $$\mathrm{diff}_p^{Max} = \mathrm{Max}\left\{ |\mathrm{diff}_p(k)| \,,\, k = (i-23), \ldots, (i-9) \right\}$$

$$\begin{aligned}
&\mathrm{Min}_j \{ ((\mathrm{diff}_p(j) \le (-\mathrm{diff}_p^{Max} - \mathrm{Offset}_1^{DE})) \wedge \\
&\quad (\mathrm{diff}_p(j+1) \le (-\mathrm{diff}_p^{Max} - \mathrm{Offset}_2^{DE})) \wedge \\
&\quad (\mathrm{diff}_p(j+2) \le (-\mathrm{diff}_p^{Max} - \mathrm{Offset}_3^{DE}))\}_{j=(i-8)\ldots(i+2)} \\
&\quad \}=j_{min} \\
&\quad \mathrm{Counter}_{cylinder}^{DE} = \mathrm{Counter}_{cylinder}(j_{min} - 1) \\
&\quad n_{act}^{DE} = n_{act}(j_{min} - 1)
\end{aligned}$$

| Time | Index | High pressure | Differential high pressure | Cylinder counter | Engine speed |
|---|---|---|---|---|---|
| $t_2$ - 25 Ta | i - 25 | $p_{dyn}(i-25)$ | $\mathrm{diff}_p(i-25) = p_{dyn}(i-25) - p_{dyn}(i-26)$ | $\mathrm{Counter}_{cylinder}(i-25)$ | $n_{act}(i-25)$ |
| $t_2$ - 24 Ta | i - 24 | $p_{dyn}(i-24)$ | $\mathrm{diff}_p(i-24) = p_{dyn}(i-24) - p_{dyn}(i-25)$ | $\mathrm{Counter}_{cylinder}(i-24)$ | $n_{act}(i-24)$ |
| $t_2$ - 23 Ta | i - 23 | $p_{dyn}(i-23)$ | $\mathrm{diff}_p(i-23) = p_{dyn}(i-23) - p_{dyn}(i-24)$ | $\mathrm{Counter}_{cylinder}(i-23)$ | $n_{act}(i-23)$ |
| $t_2$ - 22 Ta | i - 22 | $p_{dyn}(i-22)$ | $\mathrm{diff}_p(i-22) = p_{dyn}(i-22) - p_{dyn}(i-23)$ | $\mathrm{Counter}_{cylinder}(i-22)$ | $n_{act}(i-22)$ |
| $t_2$ - 21 Ta | i - 21 | $p_{dyn}(i-21)$ | $\mathrm{diff}_p(i-21) = p_{dyn}(i-21) - p_{dyn}(i-22)$ | $\mathrm{Counter}_{cylinder}(i-21)$ | $n_{act}(i-21)$ |
| $t_2$ - 20 Ta | i - 20 | $p_{dyn}(i-20)$ | $\mathrm{diff}_p(i-20) = p_{dyn}(i-20) - p_{dyn}(i-21)$ | $\mathrm{Counter}_{cylinder}(i-20)$ | $n_{act}(i-20)$ |
| $t_2$ - 19 Ta | i - 19 | $p_{dyn}(i-19)$ | $\mathrm{diff}_p(i-19) = p_{dyn}(i-19) - p_{dyn}(i-20)$ | $\mathrm{Counter}_{cylinder}(i-19)$ | $n_{act}(i-19)$ |
| $t_2$ - 18 Ta | i - 18 | $p_{dyn}(i-18)$ | $\mathrm{diff}_p(i-18) = p_{dyn}(i-18) - p_{dyn}(i-19)$ | $\mathrm{Counter}_{cylinder}(i-18)$ | $n_{act}(i-18)$ |
| $t_2$ - 17 Ta | i - 17 | $p_{dyn}(i-17)$ | $\mathrm{diff}_p(i-17) = p_{dyn}(i-17) - p_{dyn}(i-18)$ | $\mathrm{Counter}_{cylinder}(i-17)$ | $n_{act}(i-17)$ |
| $t_2$ - 16 Ta | i - 16 | $p_{dyn}(i-16)$ | $\mathrm{diff}_p(i-16) = p_{dyn}(i-16) - p_{dyn}(i-17)$ | $\mathrm{Counter}_{cylinder}(i-16)$ | $n_{act}(i-16)$ |
| $t_2$ - 15 Ta | i - 15 | $p_{dyn}(i-15)$ | $\mathrm{diff}_p(i-15) = p_{dyn}(i-15) - p_{dyn}(i-16)$ | $\mathrm{Counter}_{cylinder}(i-15)$ | $n_{act}(i-15)$ |
| $t_2$ - 14 Ta | i - 14 | $p_{dyn}(i-14)$ | $\mathrm{diff}_p(i-14) = p_{dyn}(i-14) - p_{dyn}(i-15)$ | $\mathrm{Counter}_{cylinder}(i-14)$ | $n_{act}(i-14)$ |
| $t_2$ - 13 Ta | i - 13 | $p_{dyn}(i-13)$ | $\mathrm{diff}_p(i-13) = p_{dyn}(i-13) - p_{dyn}(i-14)$ | $\mathrm{Counter}_{cylinder}(i-13)$ | $n_{act}(i-13)$ |
| $t_2$ - 12 Ta | i - 12 | $p_{dyn}(i-12)$ | $\mathrm{diff}_p(i-12) = p_{dyn}(i-12) - p_{dyn}(i-13)$ | $\mathrm{Counter}_{cylinder}(i-12)$ | $n_{act}(i-12)$ |
| $t_2$ - 11 Ta | i - 11 | $p_{dyn}(i-11)$ | $\mathrm{diff}_p(i-11) = p_{dyn}(i-11) - p_{dyn}(i-12)$ | $\mathrm{Counter}_{cylinder}(i-11)$ | $n_{act}(i-11)$ |
| $t_2$ - 10 Ta | i - 10 | $p_{dyn}(i-10)$ | $\mathrm{diff}_p(i-10) = p_{dyn}(i-10) - p_{dyn}(i-11)$ | $\mathrm{Counter}_{cylinder}(i-10)$ | $n_{act}(i-10)$ |
| $t_2$ - 9 Ta | i - 9 | $p_{dyn}(i-9)$ | $\mathrm{diff}_p(i-9) = p_{dyn}(i-9) - p_{dyn}(i-10)$ | $\mathrm{Counter}_{cylinder}(i-9)$ | $n_{act}(i-9)$ |
| $t_2$ - 8 Ta | i - 8 | $p_{dyn}(i-8)$ | $\mathrm{diff}_p(i-8) = p_{dyn}(i-8) - p_{dyn}(i-9)$ | $\mathrm{Counter}_{cylinder}(i-8)$ | $n_{act}(i-8)$ |
| $t_2$ - 7 Ta | i - 7 | $p_{dyn}(i-7)$ | $\mathrm{diff}_p(i-7) = p_{dyn}(i-7) - p_{dyn}(i-8)$ | $\mathrm{Counter}_{cylinder}(i-7)$ | $n_{act}(i-7)$ |
| $t_2$ - 6 Ta | i - 6 | $p_{dyn}(i-6)$ | $\mathrm{diff}_p(i-6) = p_{dyn}(i-6) - p_{dyn}(i-7)$ | $\mathrm{Counter}_{cylinder}(i-6)$ | $n_{act}(i-6)$ |
| $t_2$ - 5 Ta | i - 5 | $p_{dyn}(i-5)$ | $\mathrm{diff}_p(i-5) = p_{dyn}(i-5) - p_{dyn}(i-6)$ | $\mathrm{Counter}_{cylinder}(i-5)$ | $n_{act}(i-5)$ |
| $t_2$ - 4 Ta | i - 4 | $p_{dyn}(i-4)$ | $\mathrm{diff}_p(i-4) = p_{dyn}(i-4) - p_{dyn}(i-5)$ | $\mathrm{Counter}_{cylinder}(i-4)$ | $n_{act}(i-4)$ |
| $t_2$ - 3 Ta | i - 3 | $p_{dyn}(i-3)$ | $\mathrm{diff}_p(i-3) = p_{dyn}(i-3) - p_{dyn}(i-4)$ | $\mathrm{Counter}_{cylinder}(i-3)$ | $n_{act}(i-3)$ |
| $t_2$ - 2 Ta | i - 2 | $p_{dyn}(i-2)$ | $\mathrm{diff}_p(i-2) = p_{dyn}(i-2) - p_{dyn}(i-3)$ | $\mathrm{Counter}_{cylinder}(i-2)$ | $n_{act}(i-2)$ |
| $t_2$ - Ta | i - 1 | $p_{dyn}(i-1)$ | $\mathrm{diff}_p(i-1) = p_{dyn}(i-1) - p_{dyn}(i-2)$ | $\mathrm{Counter}_{cylinder}(i-1)$ | $n_{act}(i-1)$ |
| $t_2$ | i | $p_{dyn}(i)$ | $\mathrm{diff}_p(i) = p_{dyn}(i) - p_{dyn}(i-1)$ | $\mathrm{Counter}_{cylinder}(i)$ | $n_{act}(i)$ |
| $t_2$ + Ta | i + 1 | $p_{dyn}(i+1)$ | $\mathrm{diff}_p(i+1) = p_{dyn}(i+1) - p_{dyn}(i)$ | $\mathrm{Counter}_{cylinder}(i+1)$ | $n_{act}(i+1)$ |
| $t_2$ + 2 Ta | i + 2 | $p_{dyn}(i+2)$ | $\mathrm{diff}_p(i+2) = p_{dyn}(i+2) - p_{dyn}(i+1)$ | $\mathrm{Counter}_{cylinder}(i+2)$ | $n_{act}(i+2)$ |
| $t_2$ + 3 Ta | i + 3 | $p_{dyn}(i+3)$ | $\mathrm{diff}_p(i+3) = p_{dyn}(i+3) - p_{dyn}(i+2)$ | $\mathrm{Counter}_{cylinder}(i+3)$ | $n_{act}(i+3)$ |
| $t_2$ + 4 Ta | i + 4 | $p_{dyn}(i+4)$ | $\mathrm{diff}_p(i+4) = p_{dyn}(i+4) - p_{dyn}(i+3)$ | $\mathrm{Counter}_{cylinder}(i+4)$ | $n_{act}(i+4)$ |

$p_{dyn} \ge e_s$

Fig. 6

$p_s$ = 1843 bar
$e_s$ = 80 bar
$Offset_1^{DE}$ = 1 bar
$Offset_2^{DE}$ = 6 bar
$Offset_3^{DE}$ = 9 bar $diff_p^{Max}$ = 12 bar $j_{min}$ = i - 2
$Counter_{cylinder}^{DE}$ = 5
$n_{act}^{DE}$ = 2100.1 1/min

| Time | Index | $p_{dyn}$ [bar] | $diff_p$ [bar] | $Counter_{cylinder}$ | $n_{act}$ [1/min] |
|---|---|---|---|---|---|
| $t_2$ - 25 Ta | i - 25 | 1852 | 16 | 5 | 2100.1 |
| $t_2$ - 24 Ta | i - 24 | 1846 | -6 | 7 | 2100.2 |
| $t_2$ - 23 Ta | i - 23 | 1851 | 5 | 7 | 2100.1 |
| $t_2$ - 22 Ta | i - 22 | 1849 | -2 | 9 | 2100.2 |
| $t_2$ - 21 Ta | i - 21 | 1846 | -3 | 9 | 2100.2 |
| $t_2$ - 20 Ta | i - 20 | 1847 | 1 | 11 | 2100.2 |
| $t_2$ - 19 Ta | i - 19 | 1840 | -7 | 0 | 2100.3 |
| $t_2$ - 18 Ta | i - 18 | 1844 | 4 | 1 | 2100.1 |
| $t_2$ - 17 Ta | i - 17 | 1836 | -8 | 2 | 2100.1 |
| $t_2$ - 16 Ta | i - 16 | 1838 | 2 | 3 | 2099.9 |
| $t_2$ - 15 Ta | i - 15 | 1836 | -2 | 4 | 2099.9 |
| $t_2$ - 14 Ta | i - 14 | 1848 | 12 | 5 | 2099.7 |
| $t_2$ - 13 Ta | i - 13 | 1848 | 0 | 6 | 2099.9 |
| $t_2$ - 12 Ta | i - 12 | 1848 | 0 | 7 | 2099.8 |
| $t_2$ - 11 Ta | i - 11 | 1848 | 0 | 8 | 2099.9 |
| $t_2$ - 10 Ta | i - 10 | 1842 | -6 | 9 | 2100.0 |
| $t_2$ - 9 Ta | i - 9 | 1848 | 6 | 11 | 2100.0 |
| $t_2$ - 8 Ta | i - 8 | 1838 | -10 | 11 | 2100.1 |
| $t_2$ - 7 Ta | i - 7 | 1846 | 8 | 1 | 2100.1 |
| $t_2$ - 6 Ta | i - 6 | 1833 | -13 | 1 | 2100.2 |
| $t_2$ - 5 Ta | i - 5 | 1842 | 9 | 3 | 2100.1 |
| $t_2$ - 4 Ta | i - 4 | 1831 | -11 | 3 | 2100.2 |
| $t_2$ - 3 Ta | i - 3 | 1844 | 13 | 5 | 2100.1 |
| $t_2$ - 2 Ta | i - 2 | 1815 | -29 | 5 | 2100.2 |
| $t_2$ - Ta | i - 1 | 1769 | -46 | 7 | 2099.9 |
| $t_2$ | i | 1711 | -58 | 7 | 2099.7 |
| $t_2$ + Ta | i + 1 | 1646 | -65 | 9 | 2099 |
| $t_2$ + 2 Ta | i + 2 | 1590 | -56 | 10 | 2098.4 |
| $t_2$ + 3 Ta | i + 3 | 1521 | -69 | 11 | 2097.7 |
| $t_2$ + 4 Ta | i + 4 | 1475 | -46 | 0 | 2096.9 |

$e_{dyn} \geq e_s$

Fig. 7

METHOD FOR ASCERTAINING A CONTINUOUS INJECTION OF A COMBUSTION CHAMBER, INJECTION SYSTEM, AND INTERNAL COMBUSTION ENGINE COMPRISING SUCH AN INJECTION SYSTEM

CROSS-REFERENCE TO RELATED APPLICATIONS

The present application is a 371 of International application PCT/EP2018/058804, Fled Apr. 5, 2018, which claims priority of DE 10 2017 206 416.1, filed Apr. 13, 2017, the priority of these applications is hereby claimed and these applications are incorporated herein by reference.

BACKGROUND OF THE INVENTION

The invention relates to a method for identifying a continuously injecting combustion chamber of an internal combustion engine, an injection system for an internal combustion engine and an internal combustion engine having such an injection system.

German laid-open patent application DE 10 2015 207 961 A1 discloses a method for detecting continuous injection while an internal combustion engine is operating, with which method it is possible to detect continuous injection very reliably. However, with the procedure described in said document it is still not yet possible to assign detected continuous injection to a specific combustion chamber and therefore at the same time preferably to a specific injector of the internal combustion engine. Therefore, if continuous injection is detected, further, possibly complicated and protracted measures have to be taken in order to identify the defective combustion chamber or injector, or as a precaution replace all injectors of the internal combustion engine, which, in the case of large internal combustion engines with a large number of combustion chambers, is not only laborious but also very expensive and can hardly be considered to be economical when only a single injector is actually likely to be defective.

SUMMARY OF THE INVENTION

The invention is based on the object of providing a method for identifying a continuously injecting combustion chamber of an internal combustion engine, an injection system for an internal combustion engine and an internal combustion engine having such an injection system, with which the specified disadvantages do not occur.

The object is achieved in particular in that a method for identifying a continuously injecting combustion chamber of an internal combustion engine with an injection system having a high-pressure accumulator for a fuel is provided, said method having the following steps: A high pressure in the injection system is sensed in a time-dependent fashion, wherein a high pressure in the high-pressure accumulator is particularly preferably sensed in a time-dependent fashion. At a starting time while the internal combustion engine is operating, a continuous injection detection process is begun. If continuous injection is detected, a start time of a drop in pressure which occurs chronologically before the starting time and at which the high pressure in the injection system begins to drop is identified. On the basis of the start time of the drop in pressure, a combustion chamber or group of combustion chambers to which the continuous injection can be assigned is identified. Therefore, in particular that time at which, in the case of continuous injection, the high pressure begins to drop owing to the continuous injection is identified. This permits conclusions to be drawn about the injector or injectors injecting at this time, and therefore about the combustion chambers in which a defect in the form of continuous injection may be present. This in turn permits targeted replacement of the one injector or of the injectors of the identified group of combustion chambers, the number of which is in any case smaller than the total number of injectors of the internal combustion engine, so that the fault which is present can be remedied more quickly and more cost-effectively than in the past.

A continuously injecting combustion chamber is understood here to be a combustion chamber in which continuous injection is occurring, consequently, in particular, a combustion chamber to which a continuously injecting injector is assigned, that is to say an injector which has a defect in the form of continuous injection.

The starting time for the continuous injection detection process is preferably identified, in particular, as disclosed in German laid-open patent application DE 10 2015 207 961 A1 for the method specified there for detecting continuous injection. The method proposed here is preferably based on the method disclosed in this laid-open application and expands said method with the possibility of identifying a combustion chamber or a group of combustion chambers to which continuous injection can be assigned.

The identification of the group of combustion chambers or the combustion chamber to which continuous injection can be assigned preferably takes place on the basis of the start time of the drop in pressure and of an ignition sequence of the combustion chambers. This can be linked to a sampling period for sensing the high pressure, in order to identify that combustion chamber or that group of combustion chambers which has an effect on the measured high pressure at the start time of the pressure drop. The sensing of the high pressure accordingly preferably takes place discreetly, in particular with a predetermined sampling frequency and a predetermined sampling period. In particular, this permits an assignment of the start time of the pressure drop to a specific combustion chamber or to a specific group of combustion chambers via the ignition sequence of the combustion chambers.

According to one development of the invention there is provision that an earliest start time of continuous injection is determined on the basis of the starting time. This is based on the concept that—in particular on the basis of the definition of the starting time which will be explained below—there is, proceeding into the past from the starting time, an earliest time at which the continuous injection can have begun at the earliest, wherein this time is referred to as the earliest start time of the continuous injection. This start time of continuous injection can be determined, in particular, as a function of a setpoint differential pressure value which is present at the starting time because it can be assumed on the basis thereof that at most a specific time passes until the high pressure has dropped by a specific value. The start time of the pressure drop is then identified in an identification time interval between the earliest start time of continuous injection and an interval end time which is determined as a function of the starting time. The search for the start time of the pressure drop is therefore restricted to the identification time interval between the earliest start time of continuous injection and the specific interval end time, which simplifies and speeds up the method. In this context, preferably either the starting time or—in order to increase the certainty of the method—a time which occurs chronologically after the starting time is selected as the interval end time. In this context, the starting time basically characterizes a time at which the start time of the pressure drop can already not occur because, of course, according to the definition which will be explained below, the pressure drop must already have begun beforehand. Nevertheless, a time which occurs chronologically after the starting time can also be selected as an interval end time, in order to increase further the certainty and reliability of identification of the start time of the pressure drop. A particularly suitable interval end time occurs precisely two sampling periods of the high pressure after the starting time. However, the interval end time can also occur, for example, one sampling period after the starting time.

The start time of the pressure drop is preferably identified as that time at which a high pressure drop of the high pressure first reaches or exceeds a specific high-pressure drop limiting value. Alternatively, it is possible that the start time of the pressure drop is identified at that time which occurs chronologically before, by a specific shift value, the time at which the high-pressure drop first reaches or exceeds a specific high-pressure drop limiting value. In this context, the exceeding of a specific high-pressure drop limiting value can be selected as a suitable criterion for commencing continuous injection. In order to increase the certainty when determining the start time of the pressure drop, it is nevertheless possible that precisely the time at which the high-pressure drop first reaches or exceeds the specific high-pressure drop limiting value is not selected but rather a time which occurs chronologically before this time, particularly preferably a time which occurs precisely one sampling period before the time described above. In this case the specific shift value is precisely one sampling period.

Of course, the high-pressure drop typically has, as a differential pressure, a negative sign. Correspondingly, the high-pressure drop limiting value is also typically assigned a negative sign. The fact that the high-pressure drop reaches or exceeds the specific high-pressure drop limiting value is to be understood as meaning that the high-pressure drop—which has a negative sign—is in terms of absolute value equal to or greater than the absolute value of the high-pressure drop limiting value—which also has a negative sign—so that in any case owing to the high pressure drop the high pressure drops to a greater extent than is predefined by the high-pressure drop limiting value.

According to one development of the invention there is provision that a fluctuation measure is identified for fluctuation of the high pressure outside continuous injection. This serves—as will be explained in more detail below—to increase further the certainty and reliability of the method, wherein the statement "outside continuous injection" relates to the fact that the fluctuation measure is identified for the fluctuation of the high pressure in a time interval at which continuous injection does not occur, so that the fluctuation measure provides conclusive information about the fluctuation of the high pressure in the fault-free state of the injection system. The high-pressure drop limiting value is preferably determined as a function of the identified fluctuation measure. This prevents incorrectly positively identified start times of the pressure drop, which could come about, in particular, by virtue of the fact that an excessively low limiting value is selected for the high-pressure drop, so that fluctuations in the high pressure which already occur in the fault-free state would be erroneously evaluated as the beginning of a continuous injection event. The high-pressure drop limiting value is therefore determined, in particular, in such a way that a high-pressure drop which occurs in the fault-free state of the injection system owing to natural fluctuation of the high pressure does not bring about identification as the beginning of a continuous injection event.

A maximum fluctuation of the high pressure in a specific fluctuation time interval is preferably identified as a fluctuation measure. The selection of the maximum fluctuation of the high pressure as a fluctuation measure increases the certainty of the method here, in particular in comparison with a mean value or median value of the high-pressure fluctuations, because—given the suitable definition of the fluctuation time interval—it can, as it were, be ruled out that a fluctuation in the high pressure which occurs in the fault-free state is erroneously considered to be the beginning of continuous injection. In this context, the fluctuation in the high pressure in the fluctuation time interval is preferably considered in terms of absolute value, that is to say it is not significant whether the fluctuation occurs as an increase in high pressure or as a drop in high pressure. Therefore, the greatest possible variation in the high pressure—irrespective of the direction in which it occurs—within the fluctuation time interval is considered to be a maximum fluctuation.

Alternatively or additionally, the specific fluctuation time interval is preferably selected in such a way that it occurs completely chronologically before the earliest start time of the continuous injection. This ensures that in every case the continuous injection does not occur in the fluctuation time interval, so that said time interval actually only takes into account high-pressure fluctuations for the fault-free injection system. In this case, the fluctuation time interval can, in particular, be selected such that its latest time or end time falls precisely one sampling period before the earliest continuous-injection start time, wherein its earliest time, that is to say its start time preferably occurs at least 70 ms to at maximum 100 ms, particularly preferably 75 ms, before the end time, so that the fluctuation time interval preferably extends over at least 70 ms to a maximum 100 ms, and preferably over 75 ms. In the case of a sampling period of 5 ms, the fluctuation time interval preferably comprises fifteen sampled values, in particular immediately before the earliest continuous-injection start time.

Alternatively or additionally, the fluctuation measure is preferably used as the high-pressure drop limiting value. Alternatively, it is possible—in particular in order to increase the certainty of the method—to use the fluctuation measure plus an addition term as the fluctuation measure. For a continuous-injection start time to be detected, the high-pressure drop must therefore also be greater, in absolute value, than the fluctuation measure by an amount equal to the addition term. The addition term is therefore offset with the fluctuation measure in such a way that the latter is not increased in absolute value. If, for example, the fluctuation measure is provided with a negative sign because the high-pressure drop limiting value is to be given a negative sign, the addition term is also given a negative sign. The addition term is preferably also from at least 1 bar to maximum 10 bar, and is preferably 1 bar, 6 bar or 9 bar.

According to one development of the invention there is provision that an ignition sequence of the combustion chambers of the internal combustion engine is sensed in a time-dependent fashion. Crank-angle-dependent sensing can optionally take place, wherein this sensing can be converted, in particular taking into account an instantaneous rotational speed of the internal combustion engine, into time-dependent sensing. That combustion chamber or those combustion chambers is/are identified which can influence—in particular as a function of an instantaneous rotational speed which is preferably sensed in a time-dependent fashion and which the internal combustion engine has at the start time of the pressure drop—the high pressure in the injection system at the start time of the pressure drop or in a pressure drop time interval which has the start time of the pressure drop. It is obviously clear here that at the start time of the pressure drop in any case all the combustion chambers cannot contribute to the pressure drop but rather only those combustion chambers for which precisely one injection has occurred or for which the injection occurred so close in time before—or in the pressure drop time interval after—the start time of the pressure drop that its injection event can still contribute to the pressure drop at the start time of the pressure drop or in the pressure drop time interval. It is clear that this combustion chamber or these combustion chambers depend in particular on the ignition sequence and also, in particular, on the instantaneous rotational speed of the internal combustion engine. It is apparent here that —, when a sampling period for the high pressure is maintained —, the number of possibly relevant combustion chambers is lower the lower the total number of combustion chambers of the internal combustion engine and the lower the instantaneous rotational speed of the internal combustion engine at the start time of the pressure drop. Therefore, the lower the total number of combustion chambers of the internal combustion engine and the lower the instantaneous rotational speed of the internal combustion engine at the start time of the pressure drop in the maintained sampling period for the high pressure, the more accurately it is possible to narrow down the assignment of the defect of the continuous injection to a particular combustion chamber or to particular combustion chambers. Conversely, it is also the case that the more accurately this can be narrowed down, the longer the sampling period for the maintained total number of combustion chambers and the maintained instantaneous rotational speed at the start time of the pressure drop. The ignition sequence of the combustion chambers of the internal combustion engine is preferably recorded, in particular the combustion chambers are preferably incremented on the basis of the ignition sequence by means of a cylinder counter, wherein each value of the cylinder counter is assigned to precisely one combustion chamber of the internal combustion engine.

According to one development of the invention there is provision that the high pressure is sensed discreetly with a predetermined sampling period. The sampling period is preferably selected here in such a way that, firstly, sufficiently accurate and reliable observation of the development of the high pressure is possible, wherein, in particular, no relevant fluctuation events are lost, wherein, secondly, a data quantity of the data acquired within the scope of the high-pressure measurement is kept as low as possible according to the abovementioned condition. The sampling period can preferably be from at least 2 ms to a maximum 10 ms. The sampling period is preferably 5 ms.

The start time of the pressure drop is identified in the identification time interval between the earliest continuous-injection start time and the specific interval end time preferably as that sampling time at which and after which the high-pressure drop first exceeds the specific high-pressure drop limiting valve for a multiplicity of directly successive sampling times. Therefore, in particular, a specific number of directly successive sampling times is defined, wherein the high-pressure drop must reach or exceed the specific high-pressure drop limiting value at each of these directly successive sampling times so that the first sampling time of this sequence of sampling times is determined as the start time of the pressure drop. This increases the certainty of the method further, since a one-off unusually high fluctuation cannot cause a start time pressure drop to be detected, wherein instead the high-pressure drop has to persist for a certain time for the start time of the pressure drop to be detected. In this context it becomes apparent that the determination of the relevant combustion chamber or of the relevant combustion chambers for the continuous injection is more certain the greater the number of directly successive sampling times which are taken into account. However, it also becomes apparent that the number of combustion chambers which are possible for the continuous injection increases with the number of directly successive sampling times which are taken into account. The certainty of the method is therefore increased by increasing the number of directly successive sampling times which are taken into account, but, on the other hand, the accuracy with which it is possible to narrow down which combustion chambers are possibly relevant for the continuous injection is reduced. In this context, certainty of the method means that that combustion chamber among the identified combustion chambers which is actually defective is detected. Accuracy refers here to the degree to which the continuous injection can be restricted to a smallest possible number of possibly relevant combustion chambers—to precisely one combustion chamber in the case of maximum accuracy. It is obvious that these requirements are not necessarily satisfied at the same time: For example, it is possible to select the method parameters in such a way that the method results in precisely one combustion chamber, wherein precisely this selection of the method parameters brings about increased uncertainty in the sense that the combustion chamber which is identified at the end of the method is possibly not that at which a defect is actually present.

Alternatively, there is preferably provision that the start time of the pressure drop is identified in the identification time interval between the earliest start time of the continuous injection and the specific interval end time preferably as that sampling time at which and after which the high-pressure drop first continuous injection reaches or exceeds the specific high-pressure drop limiting value for a multiplicity of directly successive sampling times. In this respect, therefore, in comparison with the configuration described above only one specific shift value is additionally taken into account, that is to say the first of the multiplicity of directly successive sampling times is not directly defined as the start time of the pressure drop but rather a time which occurs chronologically before this sampling time. As already described above, this increases the accuracy of the method, since the damaging event typically occurs chronologically somewhat before the first measurable reduction in the high pressure.

The number of directly successive sampling times which are take into account within the scope of the embodiments described above is preferably two, particularly preferably three. The selection of these values constitutes, in particular, a suitable compromise between the certainty of the method, firstly, and its accuracy, secondly.

According to one development of the invention there is provision that for each sampling time of the multiplicity of directly successive sampling times, in each case a separate high-pressure drop limiting value, which is different from the high-pressure drop limiting values of the other sampling times of the multiplicity of directly successive sampling times, is used. This makes it possible to take into account the fact that the high-pressure drop typically does not take place with a constant gradient, wherein instead there is, in particular, a progressive development, and wherein the high-pressure drop accordingly becomes greater as the time progresses. This can be taken into account in that, in a particularly preferred way, the high-pressure drop limiting values for the various sampling times increase in absolute value as the time sequence of the sampling times progresses. This additionally increases the certainty of the method, since it is improbable that a progressive high-pressure drop which is above the fluctuation measure is observed outside a continuous injection event.

According to one development of the invention there is provision that the starting time is identified as that time at which the high pressure undershoots a high-pressure set-point value by an absolute predetermined starting difference pressure value. This starting differential pressure value is preferably also determined in such a way that it is typically not undershot during normal operation of the injection system. The testing for continuous injection can therefore be carried out according to requirements. The starting time is preferably determined here, in particular, as described in German laid-open patent application DE 10 2015 207 961 A1.

The object is also achieved in that an injection system for an internal combustion engine is provided which has at least one injector and at least one high-pressure accumulator, wherein the high-pressure accumulator is fluidically connected to the at least one injector. The high-pressure accumulator is preferably fluidically connected to a fuel reservoir via a high-pressure pump. The injection system also has a high-pressure sensor which is arranged and configured to sense a high pressure in the injection system, preferably to sense a high pressure in the at least one high-pressure accumulator. The injection system also has a control unit which is operatively connected to the at least one injector and to the high-pressure sensor. The injection system is defined by the fact that the control unit is configured to sense the high pressure in the injection system, preferably in the high-pressure accumulator, in order to begin a continuous-injection detection process at a starting time while the injection system is operating, in order to identify a start time of the pressure drop which occurs chronologically before the starting time and at which the high pressure in the injection system begins to drop if continuous injection has been detected, and in order to identify, on the basis of the start time of the pressure drop, a group of combustion chambers or a combustion chamber to which the continuous injection can be assigned. The control unit is, in particular, configured to carry out a method according to one of the embodiments described above. In particular, the advantages which have already been explained in conjunction with the method are realized in conjunction with the injection system.

According to one development of the invention there is provision that the control unit is configured to sense an ignition sequence of combustion chambers of an internal combustion engine having the injection system in a time-dependent fashion, optionally in a crank-angle-dependent fashion, wherein this can also be understood as meaning that the ignition sequence is stored in the control unit. The control unit is also configured to identify that combustion chamber or those combustion chambers which can influence—in particular as a function of an instantaneous rotational speed which is preferably sensed in a time-dependent fashion and which the internal combustion engine has at the start time of the pressure drop—the high pressure in the injection system at the start time of the pressure drop or in a pressure drop time interval which has the start time of the pressure drop.

The object is finally also achieved in that an internal combustion engine is provided which has an injection system according to one of the exemplary embodiments described above. In this context, in particular the advantages which have already been described in conjunction with the method and/or with the injection system are realized in conjunction with the internal combustion engine.

It is possible that the control unit of the injection system is an engine control unit of the internal combustion engine, or that the functionality of the control unit of the injection system is integrated into the engine control unit of the internal combustion engine. However, it is also possible that a separate control unit is assigned to the injection system.

The functionality of the control unit as described above can be implemented in an electronic structure, in particular in its hardware. Alternatively or additionally, it is possible that a computer program product which has instructions on the basis of which the functionality described above and, in particular, the method steps described above are/is executed when the computer program product runs on the control unit is loaded into the control unit.

In this respect, a computer program product is also preferred which has machine-readable instructions on the basis of which the functionality described above and/or the method steps described above are/is executed when the computer program product runs on a computer device, particular on a control unit.

Furthermore, a data carrier which has such a computer program product is also preferred.

The description of the method, firstly, and of the injection system and of the internal combustion engine, secondly, are to be understood as being complementary to one another. Method steps which have been described explicitly or implicitly in conjunction with the injection system or with the internal combustion engine are preferably steps, individually or combined with one another, of a preferred embodiment of the method. Features of the injection system and/or of the internal combustion engine which have been explicitly or implicitly explained in conjunction with the method are preferably features, individually or combined with one another, of a preferred exemplary embodiment of the injection system or of the internal combustion engine. The method is preferably distinguished by at least one method step which is determined by at least one feature of an inventive or preferred exemplary embodiment of the injection system and/or of the internal combustion engine. The injection system and/or the internal combustion engine are/is preferably distinguished by at least one feature which is determined by at least one method step of an inventive or preferred embodiment of the method.

BRIEF DESCRIPTION OF THE DRAWING

The invention will be explained in more detail below with reference to the drawing, in which:

FIG. 6 shows a first schematic and, in particular, tabular illustration of the method;

FIG. 7 shows a second schematic and, in particular, tabular illustration of the method.

DETAILED DESCRIPTION OF THE INVENTION

Figure 1:
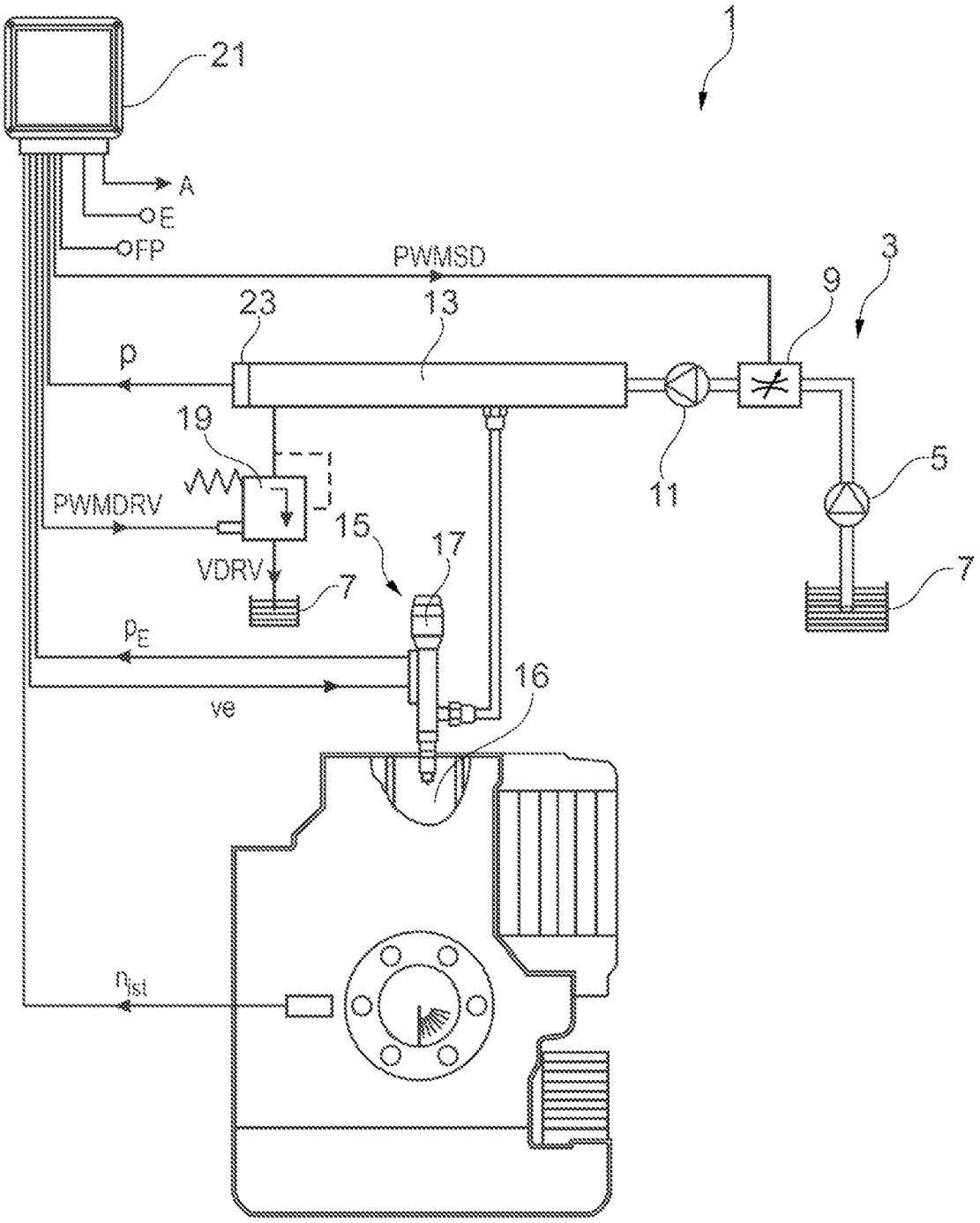
FIG. 1 shows a schematic illustration of an exemplary embodiment of an internal combustion engine.

FIG. 1 shows a schematic illustration of an exemplary embodiment of an internal combustion engine 1 which has an injection system 3. The injection system 3 is preferably embodied as a common-rail injection system. It has a low-pressure pump 5 for feeding fuel from a fuel reservoir 7, an adjustable, low-pressure-side intake manifold 9 for influencing a fuel volume flow flowing to a high-pressure pump 11, the high-pressure pump 11 for feeding the fuel with an increased pressure into a high-pressure accumulator 13, the high-pressure accumulator 13 for storing the fuel, and preferably a multiplicity of injectors 15 for injecting the fuel into combustion chambers 16 of the internal combustion engine 1. It is optionally possible that the injection system 3 is also embodied with individual accumulators, wherein an individual accumulator 17 is then, for example, integrated as an additional buffer volume into the injector 15. The exemplary embodiment illustrated here is provided with a pressure regulating valve 19 which can be actuated, in particular, in an electrical fashion and via which the high-pressure regulator 13 is fluidically connected to the fuel reservoir 7. A fuel volume flow which is discharged from the high-pressure regulator 13 into the fuel reservoir 7 is defined by means of the position of the pressure control valve 19. This fuel volume flow is denoted by VDRV in FIG. 1 and in the following text.

The mode of operation of the internal combustion engine 1 is determined by an electronic control unit 21, which is preferably embodied as an engine control unit of the internal combustion engine 1, specifically as what is referred to as an engine control unit (ECU). The electronic control unit 21 contains the customary components of a microcomputer system, for example a microprocessor, I/O modules, buffers and memory modules (EEPROM, RAM). The operational data which are relevant for the operation of the internal combustion engine 1 are applied in characteristic diagrams/characteristic lines in the memory modules. The electronic control unit 21 uses them to calculate output variables from input variables. FIG. 1 illustrates the following input variables by way of example: a measured, still unfiltered high pressure p, which is present in the high-pressure accumulator 13 and is measured by means of a high-pressure sensor 23, a current engine speed $n_{act}$, a signal FP for the specification of the power by an operator of the internal combustion engine 1, and an input variable E. Preferably further sensor signals, for example a charger pressure of an exhaust gas turbocharger, are combined under the input variable E. In an injection system 3 with individual accumulators 17 an individual accumulator pressure $p_E$ is preferably an additional input variable of the control unit 21.

FIG. 1 illustrates as output variables of the electronic control unit 21, for example, a signal PWMSD for actuating the intake manifold 9 as a first pressure actuating element, a signal ve for actuating the injectors 15—which specifies, in particular, a start of injection and/or an end of injection or else an injection duration—a signal PWMDRV for actuating the pressure control element 19 as the second pressure actuating element and an output variable A. The position of the pressure control valve 19 and therefore the fuel volume flow VDRV are defined by means of the preferably pulse-width-modulated signal PWMDRV. The output variable A is representative of further actuating signals for performing open-loop and/or closed-loop control of the internal combustion engine 1, for example for an actuating signal for activating a second exhaust gas turbocharger in the case of sequential supercharging.

Figure 2:
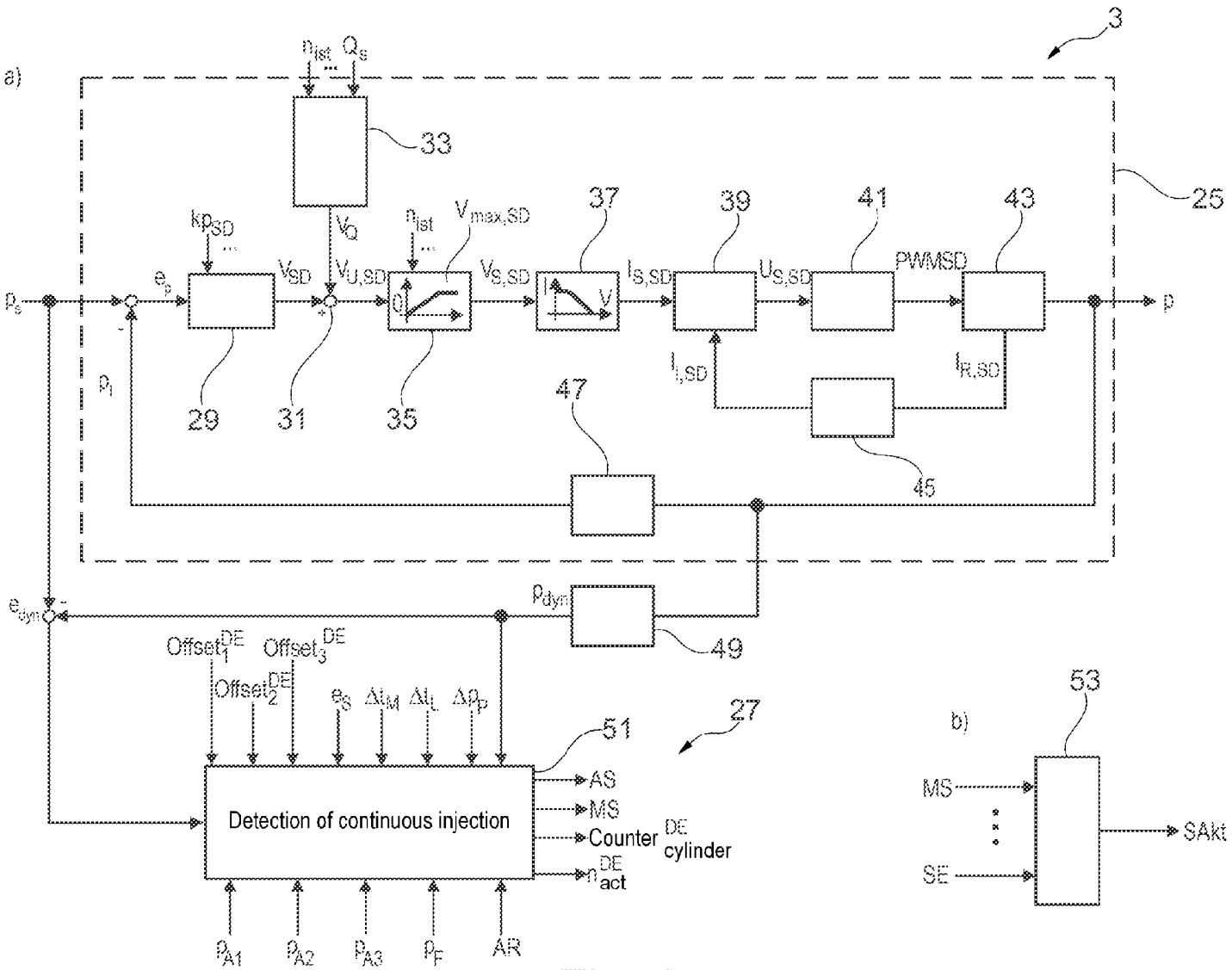
FIG. 2 shows a schematic illustration of a detail of an exemplary embodiment of an injection system.

FIG. 2*a*) shows a schematic illustration of a detail of an exemplary embodiment of an injection system 3. In this context, a high-pressure closed-loop control circuit 25, which is configured to perform closed-loop control of the high pressure in the high-pressure accumulator 13, is illustrated schematically in a box represented by a dashed line. Outside the high-pressure closed-loop control circuit 25 or the box characterized by means of the dashed line a continuous injection detection function 27 is illustrated.

The method of functioning of the high-pressure closed-loop control circuit 25 will firstly be explained in more detail. An input variable of the high pressure closed-loop control circuit 25 is a setpoint high pressure $p_S$ which is determined by the control device 21 and is compared with an actual high pressure pi in order to calculate a control error $e_p$. The setpoint high pressure $p_S$ is preferably read out of a characteristic diagram as a function of a rotational speed $n_{act}$ of the internal combustion engine 1, a load request or torque request to the internal combustion engine 1 and/or as a function of further variables, serving, in particular for correction. Further input variables of the high-pressure closed-loop control circuit 25 are, in particular, the rotational speed $n_{act}$ of the internal combustion engine 1 and a setpoint injection quantity Qs. The high-pressure closed-loop control circuit 25 has as output variable, in particular, the high pressure p which is measured by the high-pressure sensor 23. The latter is subjected—as will be explained in more detail below—to a first filtering process, wherein the actual high pressure pi results as an output variable from this first filtering process. The control error $e_p$ is an input variable of a high-pressure closed-loop controller 29, which is preferably embodied as a PI(DT1) algorithm. A further input variable of the high-pressure closed-loop controller 29 is preferably a proportional coefficient $kp_{SD}$. The output variable of the high-pressure closed-loop controller 29 is a fuel setpoint volume flow $V_{SD}$ for the intake manifold 9, to which flow a fuel setpoint consumption $V_Q$ is added at an addition point 31. This fuel setpoint consumption $V_Q$ is calculated in a first calculation element 33 as a function of the rotational speed $n_{act}$ and the setpoint injection quantity Qs and constitutes an interference variable of the high-pressure closed-loop control circuit 25. An unlimited fuel setpoint value flow $V_{U,SD}$ is obtained as a sum of the output variable $V_{SD}$ of the high-pressure closed loop controller and the interference variable $V_Q$. The former is limited to a maximum volume flow $V_{max,SD}$ for the intake manifold 9 in a limiting element 35 as a function of the rotational speed $n_{act}$. A limited fuel setpoint volume flow $V_{S,SD}$, which is input as an input variable into a pump characteristic curve 37, is obtained for the intake manifold 9, as an output variable of the limiting element 35. With said output variable, the limited fuel setpoint volume flow $V_{S,SD}$ is converted into an intake manifold setpoint flow $I_{S,SD}$.

The intake manifold setpoint flow $I_{S,SD}$ constitutes an input variable of an intake manifold flow regulator 39 which has the function of regulating an intake manifold flow through the intake manifold 9. A further input variable of the intake manifold flow regulator 39 is an actual intake manifold flow $I_{I,SD}$. The output variable of the intake manifold manifold regulator 39 is an intake manifold setpoint voltage $U_{S,SD}$, which is finally converted in a manner known per se in a second calculation element 41 into a switch-on period of a pulse-width-modulated signal PWMSD for the intake manifold 9. The intake manifold 9 is actuated with said signal PWMSD, wherein the signal therefore acts overall on a control system 43, which has, in particular, the intake manifold 9, the high-pressure pump 11 and the high-pressure accumulator 13. The intake manifold flow is measured, wherein a raw measured value $I_{R,SD}$ results, said value being filtered in a flow filter 45. The flow filter 45 is preferably embodied as a PT 1 filter. The output variable of this flow filter 45 is the actual intake manifold flow $I_{I,SD}$, which is in turn fed to the intake manifold flow regulator 39.

The control variable of the first high-pressure closed-loop control circuit 25 is the high pressure p in the high-pressure regulator 13. Raw values of this high pressure p are measured by the high-pressure sensor 23 and filtered by a first high-pressure filter element 47, which has the actual high pressure pi as output variable. The first high-pressure filter element 47 is preferably implemented by means of a PT1 algorithm.

In the text which follows, the method of functioning of the continuous injection detection function 27 will be explained in more detail: The raw values of the high pressure p are filtered by a second high-pressure filter element 49, the output variable of which is a dynamic rail pressure $p_{dyn}$. The second high-pressure filter element 49 is preferably implemented by means of a PT1 algorithm. A time constant of the first high-pressure filter element 47 is preferably greater than a time constant of the second high-pressure filter element 49. In particular, the second high-pressure filter element 49 is embodied as a faster filter than the first high-pressure filter element 47. The time constant of the second high-pressure filter element 49 can also be identical to the value zero, so that the dynamic rail pressure $p_{dyn}$ corresponds to the measured raw values of the high pressure p, and is preferably identical thereto. With the dynamic rail pressure $p_{dyn}$, a highly dynamic value for the high pressure is therefore available, which value is, in particular, always appropriate if a rapid reaction has to take place to specific events which occur.

A difference between the setpoint high pressure $p_S$ and the dynamic rail pressure $p_{dyn}$ yields a dynamic high-pressure control error $e_{dyn}$. The dynamic high-pressure control error $e_{dyn}$ is an input variable of a function block 51 for detecting continuous injection. Further—in particular parametrizable—input variables of the function block 51 are preferably various discharge pressure values, here specifically a first overpressure discharge pressure value $p_{A1}$, at or above which a mechanical overpressure valve (not illustrated in FIG. 1) can be triggered, a control discharge pressure value $p_{A2}$, at or above which the actuable pressure regulating valve 19 is actuated as a sole pressure actuating element for regulating high pressure, for example if the intake manifold 9 fails, and a second overpressure discharge pressure value $p_{A3}$, at or above which the actuable pressure regulating valve 19 is opened—preferably completely—in order to perform a protective function for the injection system 3 and therefore, as it were, replace or supplement the mechanical overpressure valve. Further—in particular parametrizable—input variables are a predetermined starting differential pressure value $e_S$, a predetermined test time interval $\Delta T_M$, a predetermined continuous-injection time interval $\Delta t_L$, a predetermined continuous-injection differential pressure value $\Delta p_P$, a fuel admission pressure $p_F$, the dynamic rail pressure $p_{dyn}$ and an alarm reset signal AR. Output variables of the function block 51 are an engine stop signal MS and an alarm signal AS.

The functionality of the function block 51 is supplemented with three further input variables and two further output variables. Additional input variables are here the predefinable parameters $\text{Offset}_1^{DE}$, $\text{Offset}_2^{DE}$ and $\text{Offset}_3^{DE}$. Additional output variables are the variables $\text{counter}_{cylinder}^{DE}$ and $n_{act}^{DE}$. The function of these parameters and variables is explained in conjunction with FIGS. 6 and 7.

FIG. 2*b*) shows that when the engine stop signal MS assumes the value 1, i.e. is set, it triggers an engine stop, in which case a logic signal SAkt, which causes the internal combustion engine 1 to stop, is also set. The triggering of an engine stop can also have different causes, e.g. the setting of an external engine stop. In this context, an external stop signal SE is identical to the value 1, and—since all the possible stop signals are connected to one another by a logic OR operation 53—the resulting logic signal SAkt is also identical to the value 1.

Figure 3:
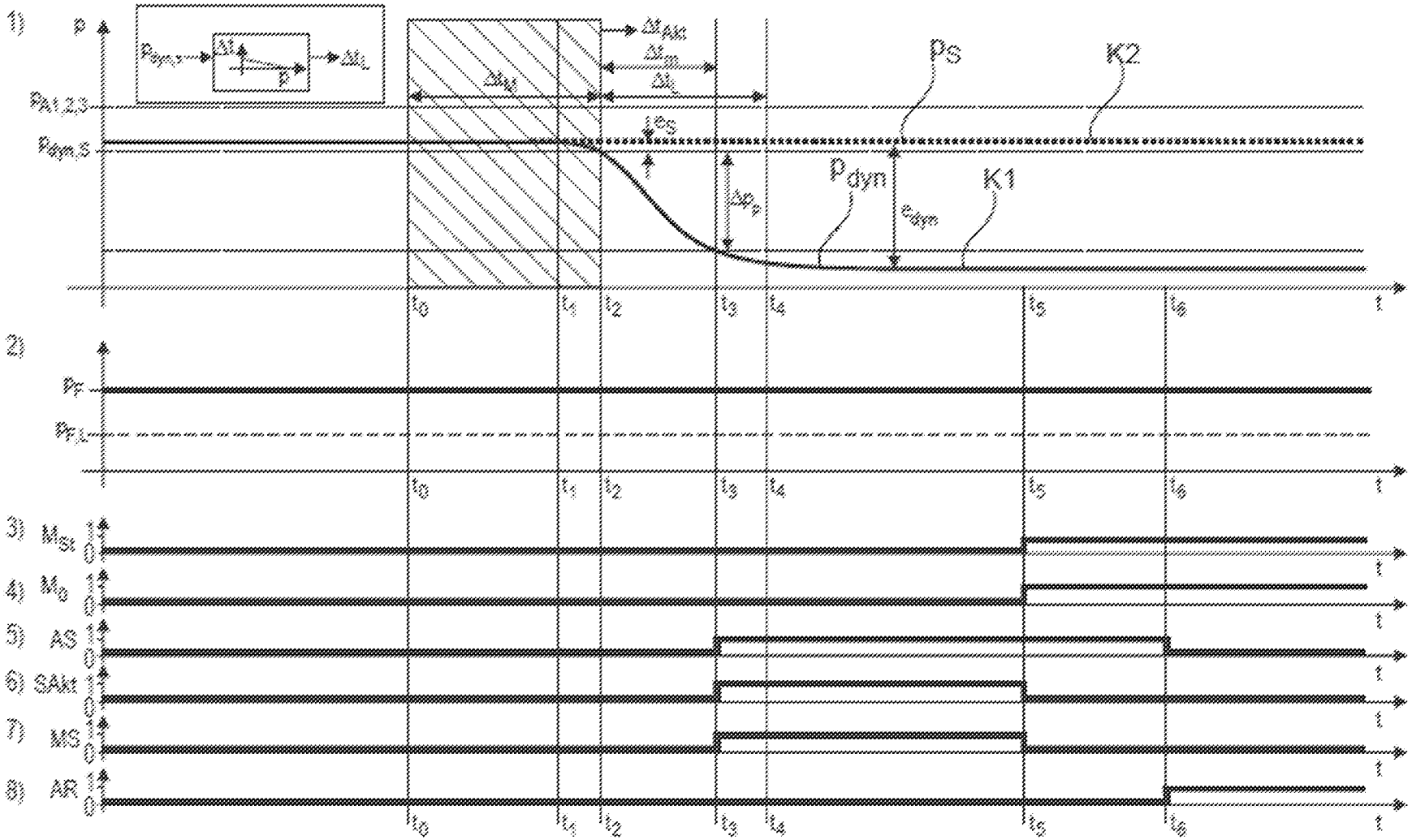
FIG. 3 shows a schematic illustration of an embodiment of the method in a diagrammatic illustration.

FIG. 3 shows a schematic illustration of an embodiment of the method in a diagrammatic illustration, in particular in the form of various time diagrams which are illustrated together. In this context, the time diagrams are denoted—from top to bottom—as the first, second etc., diagram. The first diagram is therefore, in particular, the top diagram in FIG. 3, which is adjoined in the downward direction by the following correspondingly numbered diagrams.

The first diagram illustrates the time profile—as a function of a time parameter t—of the dynamic rail pressure $p_{dyn}$ as a continuous curve K1 and the time profile of the setpoint high pressure $p_S$ as a dashed line K2. Up to a first time $t_1$, both curves K1, K2 are identical. From the first time $t_1$ onward, the dynamic rail pressure $p_{dyn}$ becomes smaller, while the setpoint high pressure $p_S$ remains constant. This results in a positive dynamic high-pressure control error $e_{dyn}$, which at a second time $t_2$—specifically the starting time—becomes identical to the starting differential pressure value $e_S$. At this time, a timer $\Delta t_{Akt}$ starts up. The dynamic rail pressure $p_{dyn}$ is identical to a starting high pressure $p_{dyn,S}$ at a time $t_2$. At a third time t3, the dynamic rail pressure $p_{dyn}$ has dropped, starting from the starting high pressure $p_{dyn,S}$, by an amount equal to the predetermined continuous-injection differential pressure value $\Delta p_P$. A typical value for $\Delta p_P$ is preferably 400 bar. The counter $\Delta t_{Akt}$ assumes the following value at the third time $t_3$:

$$\Delta t_{Akt}=\Delta t_m=t_3-t_2$$

Continuous injection is detected if the measured time period $\Delta t_m$, that is to say that time period during which the dynamic rail pressure $p_{dyn}$ falls by the amount equal to the predetermined continuous-injection differential pressure value $\Delta p_P$, is less than or equal to the predetermined continuous-injection time interval $\Delta t_L$:

$$\Delta t_m \leq \Delta t_L$$

The predetermined continuous-injection time interval $\Delta t_L$ is preferably calculated here by means of a two-dimensional curve, in particular characteristic curve, from the starting high pressure $p_{dyn,S}$. The following applies here: The lower the starting high pressure $p_{dyn,S}$, the longer the predetermined continuous-injection time interval $\Delta t_L$. Typical values for the predetermined continuous-injection time interval $\Delta t_L$ as a function of the starting high pressure $p_{dyn,S}$ are given in the following first table:

| $p_{dyn,S}$ [bar] | $\Delta t_L$ [ms] |
|---|---|
| 600 | 150 |
| 800 | 135 |
| 1000 | 120 |
| 1200 | 105 |
| 1400 | 90 |
| 1600 | 75 |
| 1800 | 60 |
| 2000 | 55 |
| 2200 | 40 |

In order to rule out the possibility of dropping of the high pressure being brought about as a result of the triggering of a discharge valve, it is tested within the scope of the method whether during the predetermined test time interval $\Delta t_M$ the high pressure has reached or exceeded at least one of the predetermined discharge pressure values, in particular the first overpressure discharge pressure value $p_{A1}$, the closed-loop discharge pressure value $p_{A2}$, and/or the second overpressure discharge pressure value $P_{a3}$.

If this is the case, that is to say if a discharge valve is triggered in the predetermined test time interval $\Delta t_M$, no continuous injection is detected. In this case, no continuous injection test is particularly preferably carried out, that is to say, in particular, starting from the second time $t_2$ it is not tested whether the high pressure has dropped within the predetermined continuous-injection time interval $\Delta t_L$ by the amount equal to the predetermined continuous-injection differential pressure value $\Delta p_P$, that is to say, in particular, that the timer $\Delta t_{Akt}$ does not even start up. A preferred value for the test time interval $\Delta t_M$ is a value of 2 s.

If a discharge valve has not been triggered in the predetermined test time interval $\Delta t_M$ and if the high pressure has dropped at the third time $t_3$ within the predetermined continuous-injection time interval $\Delta t_L$ by at least an amount equal to the predetermined continuous-injection differential pressure value $\Delta p_P$, it is tested whether the fuel admission pressure $p_F$ is higher than or equal to a predetermined admission pressure setpoint value $p_{F,L}$. If this is the case, as illustrated in the second diagram, continuous injection is detected. If this is not the case, it is assumed that the fuel admission pressure could be responsible for the dropping of the high pressure, and no continuous injection is detected.

A precondition for the execution of the continuous-injection testing is also that the internal combustion engine 1 has exited a starting phase. This is the case when the internal combustion engine 1 has reached a predetermined idling speed for the first time. A binary engine start signal $M_{St}$ (illustrated in the third diagram) then assumes the logic value 0. If it is detected that the internal combustion engine 1 is stationary, this signal is set to the logic value 1.

A further precondition for the execution of the continuous-injection testing is that the dynamic rail pressure $p_{dyn}$ has reached the setpoint high pressure $p_S$ for the first time.

If continuous injection is detected at the third time $t_3$, the alarm signal AS is set, which changes in the fifth diagram from the logic value 0 to the logic value 1. At the same time, when continuous injection is detected the internal combustion engine 1 must be shut down. Correspondingly, the engine stop signal MS, which indicates that an engine stop is triggered as a result of the detection of continuous injection, must be set from the logic value 0 to the logic value 1, which is illustrated in the seventh diagram. The same applies to the signal SAkt which brings about a stop of the internal combustion engine 1 and which ultimately causes the internal combustion engine 1 to shut down, which is illustrated, in particular, in the sixth diagram.

At a fifth time $t_5$ a stationary state of the internal combustion engine 1 is detected so that a stationary signal $M_0$, which indicates that the internal combustion engine 1 is stationary, changes from the logic value 0 to the logic value 1. At the same time, the value of the motor start signal $M_{St}$, which indicates the starting phase of the internal combustion engine 1, changes from the logic value 0 to the logic value 1, since the internal combustion engine 1 is again in the starting phase after the stationary state has been detected. If the internal combustion engine 1 is detected as being stationary, the two signals SAkt and MS are set again to 0, which is in turn illustrated in the sixth and seventh diagrams.

At a sixth time $t_6$ an alarm reset signal is activated by the operator of the internal combustion engine 1, so that the alarm reset signal AR changes, as illustrated in the eighth diagram, from the logic value 0 to the logic value 1. This in turn results in the alarm signal AS, which is assessed in the fifth diagram, being reset to the logic value 0.

If continuous injection is detected or if no continuous injection is detected before the expiry of the predetermined continuous-injection time interval $\Delta t_L$ renewed continuous-injection testing can then be carried out only if the dynamic rail pressure $p_{dyn}$ has reached or exceeded the setpoint high pressure $p_S$ again:

$p_{dyn} \geq P_S$.

The object of the invention is to identify as accurately as possible, for the case of a detected continuous injection, the combustion chamber or cylinder which is causing the continuous injection. This has the advantage that after continuous injection has been detected, it is not necessary to replace all the injectors of all the cylinders, but only a few, as result of which customer service costs can be saved.

The method according to the invention for identifying the continuously injecting cylinder is illustrated in FIGS. 4 to 8.

Figure 4:
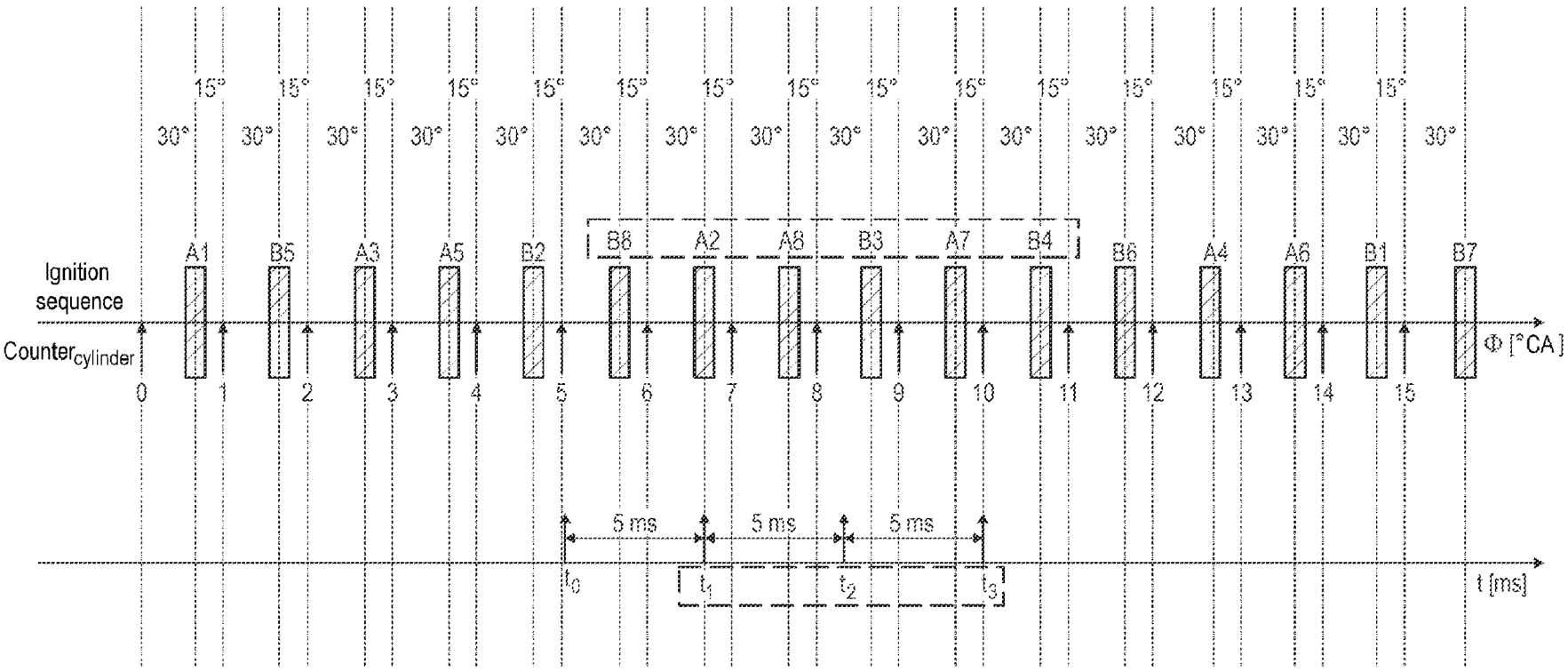
FIG. 4 shows a diagrammatic illustration of a relationship between discrete high-pressure sensing and an ignition sequence in an exemplary embodiment of an internal combustion engine at a first rotational speed.

FIG. 4 shows two diagrams, a first diagram with the crankshaft angle $\phi$ as the abscissa and a second diagram with the time t as the abscissa. The first diagram illustrates the ignition sequence of a 16-cylinder engine with two cylinder banks A, B, with eight cylinders each. The combustion chambers or cylinders of the A-side are denoted here by A1 to A8 and the cylinders of the B-side by B1 to B8. The hatched boxes represent the top dead centers of the individual cylinders here. The ignition interval, i.e. the crankshaft angle between two ignitions, is 45° in each case. The ignition is initialized in each case at an interval of 30° from the top dead center, i.e. processed by software. This is indicated in each case by arrows. The variable $counter_{cylinder}$ is incremented here in each case starting from the value 0 by the value 1 at each further cylinder. The variable $counter_{cylinder}$ thus assumes a total number of values from 0 to 15 and indicates in each case which cylinder fires next. The injection of a cylinder can begin here at the earliest after the initialization, i.e. at the earliest 30° before the top dead center. In order to explain the method according to the invention, the injection will be ended at the latest with the top dead center, for the sake of simplification.

With the second diagram, the relationship between the angle-orientated injection and the time-based sensing of the high pressure, also referred to below as rail pressure, will be exemplarily illustrated for an engine speed of 2540 l/min. Specifically, it is to be shown how many injections can influence a total of three acquired rail pressure values. The sampling period or sampling time in the control unit is 5 ms here, i.e. the rail pressure is sampled every 5 ms. In FIG. 4, four sampling times $t_0$ to $t_3$ are illustrated in this context. The initialization of the cylinder B4 occurs just before the most current sampling time $t_3$. Therefore, the injection of the cylinder B4 could begin just before the time $t_3$ and therefore influence the rail pressure acquired at the time $t_3$. The cylinder A7 begins to inject after the time $t_2$, so that as a result the sensed rail pressure is also influenced at the time $t_3$. The cylinder B3 can begin injection before the time $t_2$, so that this cylinder can influence the rail pressure sensed at the time $t_2$. The cylinder A8 begins injection before the time $t_2$ and after the time $t_1$, so that this cylinder can also influence the rail pressure sensed at the time $t_2$. The cylinder A2 begins injection before the time $t_1$, so that this cylinder influences the rail pressure sensed at the time $t_1$. The cylinder B8 can begin injection just before the time $t_0$, and as a result both the rail pressure sensed at the time $t_0$ and the rail pressure sensed at the time $t_1$ can be influenced. Therefore, in total the cylinders B8, A2, A8, B3, A7 and B4 can influence the rail pressure values acquired at the times $t_1$, $t_2$ and $t_3$, i.e. at the engine speed 2450 l/min three successive sample values can be influenced by six cylinders. For the sake of illustration, the corresponding cylinders and sampling steps are each surrounded by dashed lines.

Figure 5:
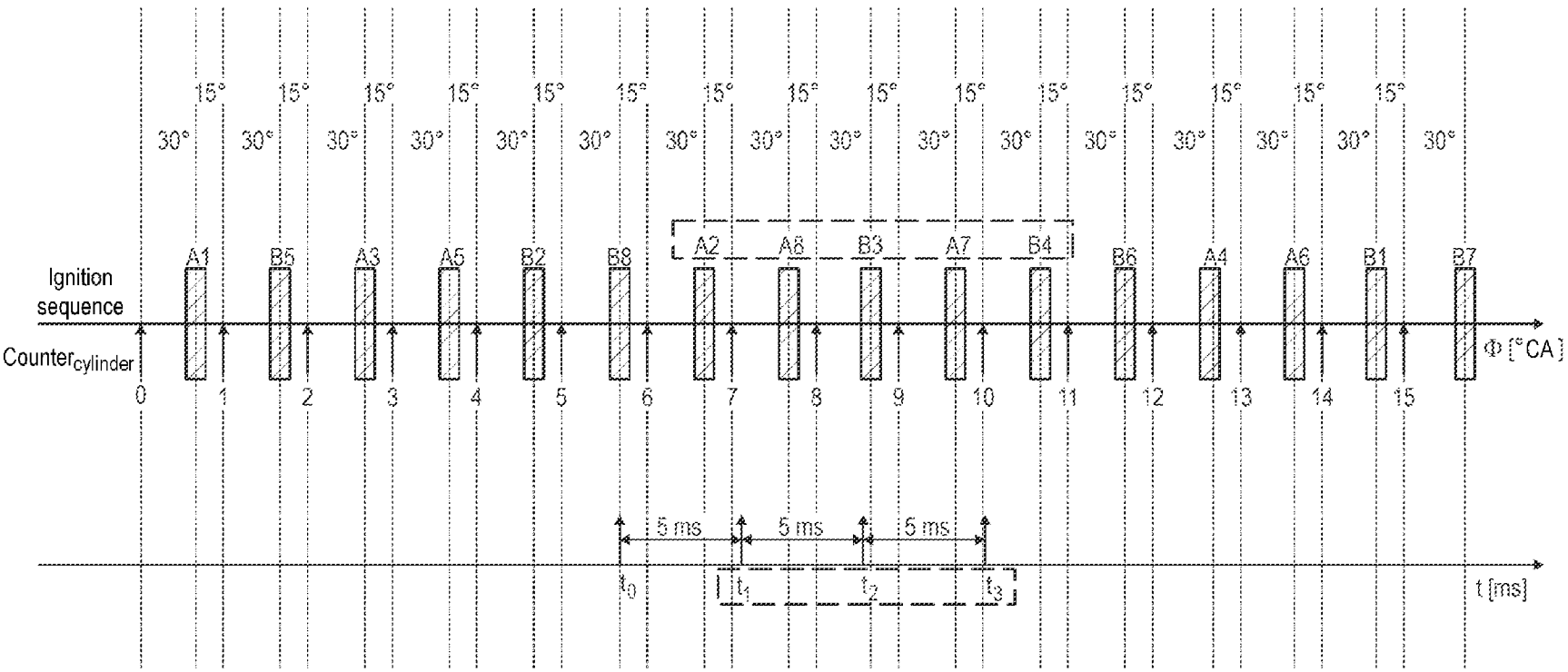
FIG. 5 shows a corresponding diagrammatic illustration according to FIG. 4 for the same internal combustion engine but at a lower rotational speed.

FIG. 5 shows in turn how many injections can influence three rail pressure values which are acquired one after the other, in this case at an engine speed of 2166.6 l/min of the same engine as in FIG. 4.

Two diagrams are also illustrated here, wherein the first diagram corresponds to the first diagram in FIG. 4. The second diagram also represents in this case four sampling times $t_0$, $t_1$, $t_2$ and $t_3$, which follow one another at an interval of 5 ms, i.e. the sampling time.

The initialization of the cylinder B4 also occurs just before the most current sampling time $t_3$ this time. Therefore, the injection of the cylinder B4 could begin just before the time $t_3$ and therefore influence the rail pressure acquired at the time $t_3$. The cylinder A7 begins to inject after the time $t_2$, so that as a result the sensed rail pressure is also influenced at the time $t_3$. The cylinder B3 can begin injection before the time $t_2$, so that this cylinder can influence the rail pressure sensed at the time $t_2$. The cylinder A8 can begin injection before the time $t_1$, and therefore this cylinder can influence the rail pressure sensed at the time $t_1$. The cylinder A2 begins injection before the time $t_1$, so that this cylinder also influences the rail pressure sensed at the time $t_1$. The cylinder B8 begins injection before the time $t_0$, and as a result the rail pressure which is sensed at the time $t_0$ is influenced, but the rail pressure which is sensed at the time $t_1$ is not influenced, since the top dead center of the cylinder B8 and therefore the end of the injection occurs just before the time $t_0$. Therefore, in total the cylinders A2, A8, B3, A7 and B4 can influence the rail pressure values acquired at the times $t_1$, $t_2$ and $t_3$, i.e. at the engine speed 2166.6 l/min three successive sampled values can be influenced by five cylinders. For the sake of illustration, the corresponding cylinders and sampling steps are each surrounded by dashed lines.

FIGS. 4 and 5 illustrate that when the engine speed is dropping, fewer cylinders correspond to the same number of sampling times.

The following second table shows, for the case of the 16-cylinder engine, the relationship between the engine speed n and the number of cylinders which can influence the rail pressure sensed over three sampling steps:

| $n_{act}$ [1/min] | Number of cylinders |
|---|---|
| 2450 | 6 |
| 2166.6 | 5 |

-continued

| $n_{act}$ [1/min] | Number of cylinders |
|---|---|
| 1666.6 | 4 |
| 1166.6 | 3 |

According to FIG. 4, at the engine speed 2450 l/min a total of six cylinders can influence the rail pressure sensed over three sampling steps. According to FIG. 5, starting from the engine speed 2166.6 l/min the rail pressure which is sensed over three sampling steps can only be influenced by five cylinders. Starting from the engine speed 1666.6 l/min, four cylinders can influence three sample values of the rail pressure. Starting from the engine speed 1166.6 l/min a total of only three cylinders can finally influence the rail pressure sensed over three sampling steps.

The following third table shows the corresponding relationship for the 12-cylinder engine:

| $n_{act}$ [1/min] | Number of cylinders |
|---|---|
| 2450 | 5 |
| 2333.3 | 4 |
| 1333.3 | 3 |
| 1000.0 | 2 |

At the engine speed 2450 l/min a total of five cylinders can influence the rail pressure sensed over three sampling steps. Starting from the engine speed 2333.3 l/min, the rail pressure which is sensed over three sampling steps can only be influenced by four cylinders. Starting from the engine speed 1333.3 l/min, three cylinders can influence three sampled values of the rail pressure. Finally, starting from the engine speed 1000 l/min a total of only two cylinders can influence the rail pressure sensed over three sampling steps.

FIG. 6 shows the detection of the continuously injecting cylinder in accordance with an embodiment of the method according to the invention. A table with 6 columns and 30 rows is illustrated. The first column of the table shows the sampling times of the high pressure, specifically of the measured dynamic rail pressure $p_{dyn}$. The sampling times are referred here to the starting time, specifically the time $t_2$, which is identical to the time $t_2$ in FIG. 3. The variable Ta denotes the sampling period. At the time $t_2$ the dynamic high-pressure control error $e_{dyn}$ is greater than or equal to the starting differential pressure value $e_S$, as result of which the starting up of the timer $\Delta t_{Akt}$ in FIG. 3 is triggered.

In the second column, each sampling time is assigned a corresponding index. The sampling time $t_2$ is assigned to the index i here.

The third column contains the dynamic rail pressure $p_{dyn}$ at the respective sampling time, that is to say $p_{dyn}(i)$ denotes the dynamic rail pressure at the starting time $t_2$.

The fourth column contains the differential high pressure $diff_p$ at the respective sampling time. The differential high pressure constitutes here the change in the dynamic rail pressure $p_{dyn}$ during a sampling step. Therefore the following applies to the differential high pressure $diff_p(i)$ at the time $t_2$:

$$diff_p(i)=p_{dyn}(i)-p_{dyn}(i-1).$$

The cylinder counter $counter_{cylinder}$ which is valid at the respective sampling time is stored in the fifth column. Therefore, $counter_{cylinder}(i)$ denotes the cylinder counter at the time $t_2$. The cylinder counter is illustrated in FIGS. 4 and 5.

The sixth column contains the engine speed $n_{act}$ at the respective sampling time. Therefore, $n_{act}(i)$ denotes the current measured engine speed at the time $t_2$.

The values stored in the table in FIG. 6 are used to detect the continuously injecting cylinder. The algorithm for detecting the continuously injecting cylinder is illustrated in the left-hand part of the table.

The starting time $t_2$ is the starting point for the method for detecting the continuously injecting cylinder and is characterized in the table by the index i.

At this time, according to FIG. 3 it is detected that the dynamic rail pressure $p_{dyn}$ has dropped significantly by an amount equivalent to the starting differential pressure value $e_S$. The object of the invention for detecting the continuously injecting cylinder is now to detect as accurately as possible the time when the continuous injection begins, that is to say the start time of the pressure drop. In FIG. 3, this is the time $t_1$. According to the table in FIG. 6, it is impossible to infer the associated value of the cylinder counter $counter_{cylinder}$. This counter is assigned a corresponding cylinder according to FIGS. 4, 5 and 8.

According to the inventive method, the change in the dynamic rail pressure $p_{dyn}$ from one sampling step to the next is used to detect the beginning of the continuous injection. The values of the differential high pressure $diff_p$ are stored in the fourth column of the table in FIG. 6. The object of the invention is to detect as accurately as possible the beginning of the drop in the dynamic rail pressure $p_{dyn}$, that is to say the start time of the pressure drop on the basis of the stored values of this signal. This is made possible by virtue of the fact that it is initially checked how the differential high pressure $diff_p$ behaves before the occurrence of the continuous injection event in a fluctuation time period. In this context, a fluctuation measure is identified which says how strong the differential high pressure $diff_p$ fluctuates in terms of absolute value at a safe interval before the beginning of the continuous injection. For this purpose, the starting time $t_2$ in the table in FIG. 6 is used as a reference point. At this time, the dynamic rail pressure $diff_p$ has already decreased by the starting differential pressure value $e_S$. A typical value for the starting differential pressure value $e_S$ is 80 bar in this context. Analytical considerations show that if the dynamic rail pressure $p_{dyn}$ has dropped by 80 bar, the earliest continuous-injection start time is 40 ms before the starting time $t_2$. Therefore, according to the table in FIG. 6, in the case of a sampling time of 5 ms the times ($t_2$−8 Ta) to $t_2$ are decisive for the occurrence of the continuous injection so that it can be assumed that the time ($t_2$−9 Ta) and earlier times are not associated with the occurrence of continuous injection.

In order to identify the fluctuation of the differential high pressure $diff_p$ in terms of absolute value before the occurrence of the event of the continuous injection, in the case of a sampling time of 5 ms typically 15 sampled values of the differential high pressure $diff_p$ are considered and therefore a time period of 75 ms is considered as the fluctuation time interval. This involves the sampling times ($t_2$−23 Ta) to ($t_2$−9 Ta). The maximum fluctuation $diff_p^{Max}$ of the differential high pressure $diff_p$ in terms of absolute value in this time period is determined as the fluctuation measure and, as illustrated in FIG. 6, is calculated in the fluctuation time interval as follows:

$$diff_p^{Max}=\mathrm{Max}\{|diff_p(k)|, k=(i-23), \ldots, (i-9\}.$$

The basic concept of the invention is that the dynamic rail pressure $p_{dyn}$ in the time period which is decisive for the detection of the continuous injection (($t_2$−8 Ta) to $t_2$) must drop to a greater extent from one sampling step to the next, specifically in the fluctuation time interval (($t_2$−23 Ta) to ($t_2$−9 Ta)), that is to say to a greater extent than the value defined by the fluctuation measure $diff_p^{Max}$. According to the inventive method, the differential high pressure $diff_p$ is checked in an identification time interval starting from the earliest continuous-injection start time ($t_2$−8 Ta), for a plurality of later times, ideally up to a specific interval end time ($t_2$+2 Ta), to determine whether the differential high pressure $diff_p$ which is lower than or equal to a high-pressure drop limiting value, which here is the regative fluctuation measure minus an addition therm, namely ($-diff_p^{Max}-Offset_1^{DE}$), wherein the predefinable parameter $Offset_1^{DE}$ as an addition term is at least 1 bar:

$$\min_j \{\{diff_p(j) \le (-diff_p^{Max} - Offset_1^{DE})\}\},$$
$$j=(i-8)\ldots(i+2)=j_{min}$$

The following then applies to the searched-for-cylinder counter $counter_{cylinder}^{DE}$ and/or to the associated engine speed $n_{act}^{DE}$:

$counter_{cylinder}^{DE}=counter_{cylinder}(j_{min})$, $n_{act}^{DE}=n_{act}(j_{min})$.

More certainty in the detection of the continuously injecting cylinder is acquired by using two or three sampled values of the differential high pressure. In this case, the continuously injecting cylinder can be identified not as an individual cylinder but rather as one of a plurality of possible cylinders. This means that in this case the continuously injecting cylinder can be restricted to a few cylinders, but in return the detection is significantly more certain. The case in which three successive sampled values of the differential high pressure $diff_p$ are used to detect the continuously injecting cylinder has proven particularly effective. In this case, the continuously injecting cylinder of a 16-cylinder engine can be limited in the worst case to six, in the best case to two cylinders by means of the inventive method, which is represented using FIGS. 4, 5 and the second table given above. The implementation of this method is illustrated on the left-hand side of FIG. 6. In this context, again starting from the earliest continuous-injection start time ($t_2$−8 Ta), up to the interval end time ($t_2$+2 Ta), the differential high pressure $diff_p$ is firstly checked, as described above, to determine whether it is lower than or equal to a first high-pressure drop limiting value, specifically the difference ($-diff_p^{Max}-Offset_1^{DE}$). If this is the case for the first time, the following sampled value of the differential high pressure is then checked to determine whether it is lower than or equal to a second high-pressure limiting value, specifically the difference ($-diff_p^{Max}-Offset_2^{DE}$), wherein the second addition term $Offset_2^{DE}$ can be predefined, wherein it is preferably greater than or equal to 1 bar and typically also greater than the first addition term $Offset_1^{DE}$. This takes into account the fact that the drop in the dynamic rail pressure $p_{dyn}$ is sped up in the case of continuous injection, i.e. the dynamic rail pressure initially drops slowly and then with increasing speed. If the test condition is also satisfied in the case of the second sampling time, it is tested for the following third sampling time whether the associated differential high pressure $diff_p$ is lower than or equal to a third high-pressure drop limiting value, specifically the difference ($-diff_p^{Max}-Offset_3^{DE}$). If this is also the case, there are therefore three successive sampling times which satisfy the corresponding test conditions. In this context, the following typical values apply for the predefinable addition terms $Offset_1^{DE}$, $Offset_2^{DE}$ and $Offset_3^{DE}$:

$Offset_1^{DE}$=1 bar,
$Offset_2^{DE}$=6 bar,
$Offset_3^{DE}$=9 bar.

In order to be able to reliably identity the continuously injecting cylinder, it must be borne in mind that continuous injection has a delayed effect on the dynamic rail pressure $p_{dyn}$. For this reason, it is particularly effective if the first of the three sampling times which satisfy the corresponding test conditions is not considered to be decisive for the occurrence of the continuous injection but rather the sampling time directly before the first of the three checked sampling times. The first cylinder which is possibly relevant in the ignition sequence in respect of causing the continuous injection can therefore be according to the following algorithm:

$$\begin{aligned}\underset{j}{\mathrm{Min}}\ \{\{&(diff_p(j) \le (-diff_p^{Max} - Offset_1^{DE}))\\ &\wedge(diff_p(j+1) \le (-diff_p^{Max} - Offset_2^{DE}))\\ &\wedge(diff_p(j+2) \le (-diff_p^{Max} - Offset_3^{DE}))\},\\ &j = (i-8)\ \ldots\ (i+2)\} = j_{min}.\end{aligned}$$

The following then applies to the searched-for cylinder counter $counter_{cylinder}$ and/or to the associated engine speed $n_{act}^{DE}$:

$$counter_{cylinder}^{DE} = counter_{cylinder}(j_{min}-1),$$

$$n_{act}^{DE} = n_{act}(j_{min}-1).$$

According to the inventive method, the dropping of the rail pressure after continuous injection has occurred is detected on the basis of three directly successive sampled values of the dynamic rail pressure $p_{dyn}$. In order to sense the continuously injecting cylinder with certainty, the sampling time which is the oldest chronologically is used as the start time of the pressure drop with a specific shift value, here set back by one sampling period (Index (min−1)). The associated cylinder counter $counter_{cylinder}(j_{min}-1)$ therefore defines the first cylinder of the ignition sequence which is possibly relevant for the continuous injection. How many cylinders in total may be the cause of the continuous injection depends on the instantaneous engine speed 1 $n_{ist}(j_{min}-1)$ at the start time of the pressure drop according to the second and third tables presented above, for the case of the 12-cylinder or 16-cylinder engine.

FIG. 7 shows the execution of the method according to the invention using the example of a 12-cylinder engine.

In the top left-hand part of FIG. 7 the values of the setpoint rail pressure $p_S$, which is assumed to be constant, and of the parameters $e_S$, $Offset_1^{DE}$, $Offset_2^{DE}$ and $Offset_3^{DE}$ are given:

$p_S$=1843 bar,
$e_S$=80 bar,
$Offset_1^{DE}$=1 bar,
$Offset_2^{DE}$=6 bar,
$Offset_3^{DE}$=9 bar.

The illustrated table has the same structure as the corresponding table in FIG. 6, with the difference that in this case, exemplary measured values are entered for the dynamic rail pressure $p_{dyn}$, the differential high pressure $diff_p$, the cylinder counter $counter_{cylinder}$ and the engine speed $n_{act}$. At the starting time $t_2$ the dynamic rail pressure $p_{dyn}$ assumes the value 1711 bar. Since the setpoint rail pressure $p_S$ is 1843 bar, the following dynamic rail pressure control error $e_{dyn}$ is produced:

$$\begin{aligned}e_{dyn} &= p_S - p_{dyn}\\ &= 1843\ \text{bar} - 1711\ \text{bar}\\ &= 132\ \text{bar} > e_S.\end{aligned}$$

Therefore the following applies:

$e_{dyn} > e_S$.

According to FIG. 3, the timer $\Delta t_{Akt}$ now starts up and the testing of the dynamic rail pressure $p_{dyn}$ for the occurrence of continuous injection begins. If according to FIG. 3 continuous injection is detected at the third time $t_3$, the stored values of the dynamic rail pressure $P_{dyn}$ are checked according to the inventive method in order to identify the continuously injecting cylinder. For this purpose, the differential high pressure $diff_p$, i.e. the change in the dynamic rail pressure $p_{dyn}$ from one sampling step to the next is calculated. The resulting values are illustrated in the fourth column of the table in FIG. 7.

In the fluctuation time interval, the maximum differential high pressure $diff_p^{Max}$ is identified as a fluctuation measure starting from the time ($t_2$−23 Ta) up to and including the time ($t_2$−9 Ta). This results, as is stated in FIG. 7, in the value 12 bar.

The index j, for which the following condition is first satisfied in the determination time interval starting from the earliest continuous-injection start time ($t_2$−8 Ta) up to the interval endpoint ($t_2$+2 Ta), is determined:

$$\begin{aligned}\underset{j}{\mathrm{Min}}\ \{\{&(diff_p(j) \le (-diff_p^{Max} - Offset_1^{DE}))\\ &\wedge(diff_p(j+1) \le (-diff_p^{Max} - Offset_2^{DE}))\\ &\wedge(diff_p(j+2) \le (-diff_p^{Max} - Offset_3^{DE}))\},\\ &j = (i-8)\ \ldots\ (i+2)\} = j_{min}.\end{aligned}$$

If this index is denoted by $j_{min}$, the following equation is obtained with the values from FIG. 7:

$$\begin{aligned}\underset{j}{\mathrm{Min}}\ \{\{&(diff_p(j) \le (-12\ \text{bar} - 1\ \text{bar})) \wedge (diff_p(j+1) \le (-12\ \text{bar} - 6\ \text{bar}))\\ &\wedge(diff_p(j+2) \le (-12\ \text{bar} - 9\ \text{bar}))\},\\ &j = (i-8)\ \ldots\ (i+2)\} = j_{min}, \text{ and therefore}\end{aligned}$$

$$\begin{aligned}\underset{j}{\mathrm{Min}}\ \{\{&(diff_p(j) \le (-13\ \text{bar})) \wedge (diff_p(j+1) \le (-18\ \text{bar}))\\ &\wedge(diff_p(j+2) \le (-21\ \text{bar})),\ j = (i-8)\ \ldots\ (i+2)\} = j_{min}.\end{aligned}$$

This condition is satisfied for the time ($t_2$−2 Ta) according to the table in FIG. 7:

$$j_{min} = i-2.$$

For the searched-for cylinder counter $counter_{cylinder}^{DE}$ and/or the associated engine speed $n_{act}^{DE}$, the following is therefore obtained taking into account the specific shift value of one sampling period:

$$counter_{cylinder}^{DE} = counter_{cylinder}(i-3),$$

$$n_{act}^{DE} = n_{act}(i-3).$$

The corresponding sampling time ($t_2$−3 Ta) is therefore the searched-for start time of the pressure drop. The following values are therefore obtained for the $counter_{cylinder}^{DE}$ and the engine speed $n_{act}^{DE}$:

$counter_{cylinder}^{DE}=5$, $n_{act}^{DE}=2100.1$ l/min.

This is illustrated in the left-hand half of FIG. 7.

In the third table which is given above, there is an illustration, for the case of a 12-cylinder engine, of how many cylinders the continuously injecting cylinder can be narrowed down to as a function of the engine speed $n_{act}$. In the case of the engine speed 2100.1 l/min this is four cylinders, i.e. the continuously injecting cylinder can be narrowed down to four cylinders.

Figure 8:
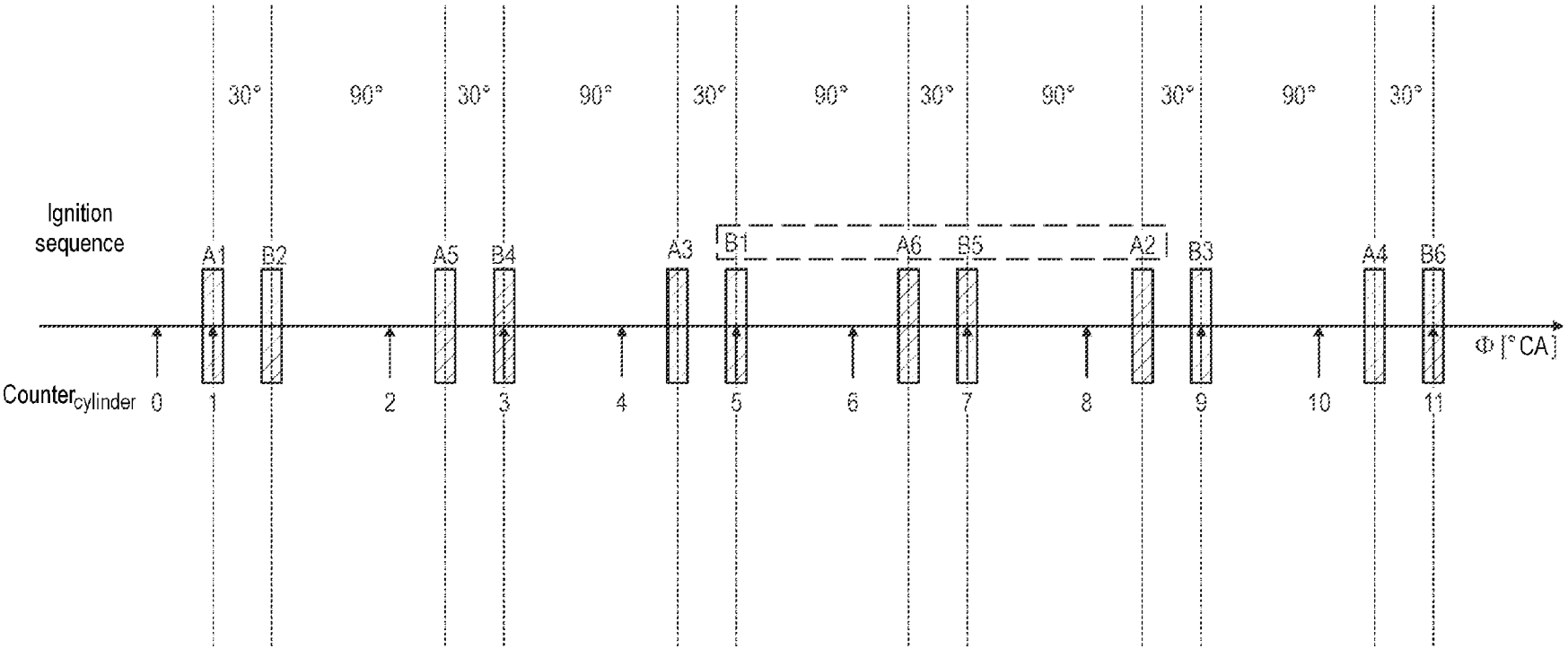
FIG. 8 shows a further diagrammatic illustration of an ignition sequence of an exemplary embodiment of an internal combustion engine which is different from the exemplary embodiment according to FIGS. 4 and 5.

FIG. 8 illustrates the ignition sequence of a 12-cylinder engine and the associated cylinder counter $counter_{cylinder}$. Since the identified cylinder counter has the value 5 and a total of four cylinders possibly relevant for the continuous injection, the cylinders in question are B1, A6, B5 and A2.

These are surrounded by dashed lines in FIG. 8.

The invention has in particular the following features:

When continuous injection is detected, the cylinder causing it can be identified or narrowed down to a small number of cylinders.

The identification of the continuously injecting cylinder is carried out by evaluating the curve of the dynamic rail pressure.

The evaluation of the dynamic rail pressure has the objective of detecting as accurately as possible the beginning of the drop in the rail pressure in the case of continuous injection.

One or more sampled values of the dynamic rail pressure can be used to identify the continuously injecting cylinder.

The more sampled values of the dynamic rail pressure are used, the greater the number of possibly relevant cylinders and therefore the more certain the informative value of the result.

The number of possibly relevant cylinders depends on the engine speed at which the continuous injection occurs. The lower the engine speed, the lower the number of possibly relevant cylinders.

The continuously injecting cylinder can be identified using the cylinder counter. This specifies which cylinder in the ignition sequence is the first to be possibly relevant for the continuous injection. Depending on the number of considered sampling times of the dynamic rail pressure and on the engine speed, further cylinders become possibly relevant for the continuous injection.

Overall, it is apparent that the method, the injection system and the internal combustion engine proposed here not only permit continuous injection to be detected with certainty but also make it possible to assign with certainty and as accurately as possible the continuous injection to a specific combustion chamber or to a number of combustion chambers of an internal combustion engine, which number is, at any rate, lower than the total number of combustion chambers.

The invention claimed is:

1. A method for identifying a continuously injecting combustion chamber of an internal combustion engine having combustion chambers and an injection system with a high-pressure accumulator for a fuel, the method comprising the steps of:

sensing of a high pressure in the injection system over time;

starting a continuous injection detection process while the internal combustion engine is operating;

identifying a start time of a pressure drop that occurs chronologically before the starting of the continuous injection detection process and at which the high pressure in the injection system begins to drop if continuous injection has been detected; and identifying at least one combustion chamber to which the continuous injection can be assigned based on the start time of the pressure drop.

2. The method according to claim 1, further including determining an earliest start time of the continuous injection proceeding from the starting of the continuous injection detection process, wherein the start time of the pressure drop is identified in an identification time interval between the earliest start time of the continuous injection and an interval end time that is determined as a function of the starting time, wherein the start time of the pressure drop is identified as a time a) at which a high-pressure drop in the high pressure first reaches or exceeds a specific high-pressure drop limiting value, or b) which occurs chronologically before, by a specific shift value, the time at which the high-pressure drop in the high pressure first reaches or exceeds a specific high-pressure drop limiting value.

3. The method according to claim 2, including identifying a fluctuation measure for fluctuation of the high pressure outside the continuous injection, wherein the high-pressure drop limiting value is determined as a function of the identified fluctuation measure, wherein a maximum fluctuation of the high pressure in a specific fluctuation time interval is identified as a fluctuation measure.

4. The method according to claim 1, further including sensing an ignition sequence of the combustion chambers of the internal combustion engine in a time-dependent fashion, wherein that combustion chamber or those combustion chambers is/are identified that can influence the high pressure in the injection system at the start time of the pressure drop or in a pressure-drop time interval which comprises the start time of the pressure drop.

5. The method according to claim 4, wherein the combustion chamber is identified as a function of an instantaneous rotational speed of the internal combustion engine at the start time of the pressure drop.

6. The method according to claim 2, including sensing the high pressure discreetly with a predetermined sampling period, wherein the start time of the pressure drop is identified in the identification time interval between the earliest start time of the continuous injection and the specific interval end time as a sampling time a) at which and after which the high-pressure drop first reaches or exceeds the specific high-pressure drop limiting value for a plurality of directly successive sampling times, or b) which occurs chronologically before, by a specific shift value, the sampling time at which and after which the high-pressure drop first reaches or exceeds the specific high-pressure drop limiting value for a plurality of directly successive sampling times.

7. The method according to claim 6, wherein for each sampling time of the plurality of directly successive sampling times, in each case a separate high-pressure drop limiting value, which is different from the high-pressure drop limiting values of the other sampling times of the plurality of directly successive sampling times, is used, wherein the high-pressure drop limiting values increase with increasing sampling times.

8. The method according to claim 1, including identifying the start time as a time at which the high pressure undershoots a high-pressure setpoint value by an absolute predetermined starting difference pressure value.

9. An injection system for an internal combustion engine having combustion chambers, comprising:

at least one injector;

at least one high-pressure accumulator that has a fluidic connection to the at least one injector;

a high-pressure sensor arranged and configured to sense a high pressure in the injection system; and a control unit operatively connected to the at least one injector and to the high-pressure sensor, wherein the control unit is configured to sense the high pressure in the injection system as a function of the time, in order to start a continuous-injection detection process while the injection system is operating, in order to identify a start time of a pressure drop which occurs chronologically before the start of the continuous-injection detection process, when continuous injection is detected, wherein the start time of a pressure drop is a time at which the high pressure in the injection system begins to drop, and wherein the control unit is configured to identify, based on the start time of the pressure drop, at least one combustion chamber to which the continuous injection is assignable.

10. The injection system according to claim 9, wherein the control unit is configured to sense in a time-dependent fashion an ignition sequence of the combustion chambers of the internal combustion engine, and to identify that combustion chamber or those combustion chambers that influence, as a function of an instantaneous rotational speed of the internal combustion engine at the start time of the pressure drop, the high pressure at the start time of the pressure drop or in a pressure-drop time interval, in the injection system, which comprises the start time of the pressure drop.

11. An internal combustion engine, comprising: combustion chambers; and an injection system according to claim 9.

12. The method according to claim 2, including identifying a fluctuation measure for fluctuation of the high pressure outside the continuous injection, wherein the high-pressure drop limiting value is determined as a function of the identified fluctuation measure, wherein the fluctuation measure is identified within a specific fluctuation time interval that occurs chronologically before the earliest start time of the continuous injection.

13. The method according to claim 2, including identifying a fluctuation measure for fluctuation of the high pressure outside the continuous injection, wherein the high-pressure drop limiting value is determined as a function of the identified fluctuation measure, wherein the fluctuation measure or the fluctuation measure plus an addition term is used as the high-pressure drop limiting value.

* * * * *